US006855673B2

(12) United States Patent
Cotter et al.

(10) Patent No.: US 6,855,673 B2
(45) **Date of Patent: *Feb. 15, 2005**

(54) FREEZE TOLERANT FRICTION CONTROL COMPOSITIONS

(75) Inventors: John Cotter, North Vancouver (CA); Don Eadie, North Vancouver (CA)

(73) Assignee: Kelsan Technologies Corporation, North Vancouver (CA)

( * ) Notice: Subject to any disclaimer, the term of this patent is extended or adjusted under 35 U.S.C. 154(b) by 0 days.

This patent is subject to a terminal disclaimer.

(21) Appl. No.: 10/291,197

(22) Filed: Nov. 8, 2002

(65) Prior Publication Data

US 2004/0092407 A1 May 13, 2004

(51) Int. Cl.[7] ..... C10M 173/02

(52) U.S. Cl. ..... 508/143; 508/154; 508/162; 508/216; 508/219; 508/220; 508/485; 508/539; 508/579; 508/583

(58) Field of Search ..... 508/143, 154, 508/162, 216, 219, 220

(56) References Cited

U.S. PATENT DOCUMENTS

| | | | | | |
|---|---|---|---|---|---|
| 4,111,820 | A | * | 9/1978 | Conti | 508/154 |
| 4,425,244 | A | * | 1/1984 | House | 508/143 |
| 4,673,516 | A | * | 6/1987 | Berry | 508/214 |
| 4,781,847 | A | * | 11/1988 | Weitz | 508/216 |
| 4,802,998 | A | * | 2/1989 | Mueller et al. | 507/134 |
| 4,915,856 | A | | 4/1990 | Jamison | 508/103 |
| 5,173,204 | A | | 12/1992 | Chiddick et al. | 508/167 |
| 5,242,506 | A | * | 9/1993 | Barber et al. | 148/22 |
| 5,308,516 | A | | 5/1994 | Chiddick | 508/161 |
| 5,492,642 | A | | 2/1996 | Mulvihill et al. | 508/579 |
| 6,228,816 | B1 | * | 5/2001 | Ito et al. | 508/143 |
| 6,387,854 | B1 | | 5/2002 | Sedelmeier et al. | 508/579 |
| 6,673,754 | B1 | * | 1/2004 | Nabeshima et al. | 508/507 |

FOREIGN PATENT DOCUMENTS

| | | |
|---|---|---|
| EP | 0 372 559 B1 | 7/1992 |
| WO | 90/15123 | 12/1990 |
| WO | 98/13445 | 4/1998 |
| WO | 02/26919 A2 | 4/2002 |

OTHER PUBLICATIONS

H. Harrison, T. McCanney and J. Cotter (2000), Recent Development in COF Measurements at the Rail/Wheel Interface, Proceeding The 5th International Conference on Contact Mechanics and Wear of Rail/Wheel Systems CM 2000 (SEIKEN Symposium No. 27), pp. 30–34.

A. Matsumo, Y. Sato, H. Ono, Y. Wang, M. Yamamoto, M.Tanimoto and Y. Oka (2000), Creep force characteristics between rail and wheel scaled model, Proceedings The 5th International Conference on Contact Mechanics and Wear of Rail/Wheel Systems CM 2000 (SEIKEN Symposium No. 27) pp. 197–202.

* cited by examiner

*Primary Examiner*—Ellen M. McAvoy
(74) *Attorney, Agent, or Firm*—Merchant & Gould P.C.

(57) ABSTRACT

According to the invention there is provided a liquid friction control composition for use in low temperature conditions, which comprises a rheological control agent, a consistency modifier and a freezing point depressant. The liquid friction control composition may also comprise other components such as a retentivity agent, an antioxidant, a friction modifier, a lubricant, a wetting agent, and a preservative.

31 Claims, No Drawings

FREEZE TOLERANT FRICTION CONTROL COMPOSITIONS

The invention relates to friction control compositions for applying to surfaces which are in sliding or rolling-sliding contact. More specifically, the present invention relates to friction control compositions for use in a range of temperatures including low temperature conditions.

BACKGROUND OF THE INVENTION

The control of friction and wear of metal mechanical components that are in sliding or rolling-sliding contact is of great importance in the design and operation of many machines and mechanical systems. For example, many steel-rail and steel-wheel transportation systems including freight, passenger and mass transit systems suffer from the emission of high noise levels and extensive wear of mechanical components such as wheels, rails and other rail components such as ties. The origin of such noise emission, and the wear of mechanical components may be directly attributed to the frictional forces and behaviour that are generated between the wheel and the rail during operation of the system.

In a dynamic system wherein a wheel rolls on a rail, there is a constantly moving zone of contact. For purposes of discussion and analysis, it is convenient to treat the zone of contact as stationary while the rail and wheel move through the zone of contact. When the wheel moves through the zone of contact in exactly the same direction as the rail, the wheel is in an optimum state of rolling contact over the rail. However, because the wheel and the rail are profiled, often misaligned and subject to motions other than strict rolling, the respective velocities at which the wheel and the rail move through the zone of contact are not always the same. This is often observed when fixed-axle railcars negotiate curves wherein true rolling contact can only be maintained on both rails if the inner and the outer wheels rotate at different peripheral speeds. This is not possible on most fixed-axle railcars. Thus, under such conditions, the wheels undergo a combined rolling and sliding movement relative to the rails. Sliding movement may also arise when traction is lost on inclines thereby causing the driving wheels to slip.

The magnitude of the sliding movement is roughly dependent on the difference, expressed as a percentage, between the rail and wheel velocities at the point of contact. This percentage difference is termed creepage.

At creepage levels larger than about 1%, appreciable frictional forces are generated due to sliding, and these frictional forces result in noise and wear of components (H. Harrison, T. McCanney and J. Cotter (2000), Recent Developments in COF Measurements at the Rail/Wheel Interface, Proceedings The $5^{th}$ International Conference on Contact Mechanics and Wear of Rail/Wheel Systems CM 2000 (SEIKEN Symposium No. 27), pp. 30–34, which is incorporated herein by reference). The noise emission is a result of a negative friction characteristic that is present between the wheel and the rail system. A negative friction characteristic is one wherein friction between the wheel and rail generally decreases as the creepage of the system increases in the region where the creep curve is saturated. Theoretically, noise and wear levels on wheel-rail systems may be reduced or eliminated by making the mechanical system very rigid, reducing the frictional forces between moving components to very low levels or by changing the friction characteristic from a negative to a positive one, that is by increasing friction between the rail and wheel in the region where the creep curve is saturated. Unfortunately, it is often impossible to impart greater rigidity to a mechanical system, such as in the case of a wheel and rail systems used by most trains. Alternatively, reducing the frictional forces between the wheel and the rail may greatly hamper adhesion and braking and is not always suitable for rail applications. In many situations, imparting a positive frictional characteristic between the wheel and rail is effective in reducing noise levels and wear of components.

It is also known that, wear of train wheels and rails may be accentuated by persistent to and fro movement resulting from the presence of clearances necessary to enable a train to move over a track. These effects may produce undulatory wave patterns on rail surfaces and termed corrugations. Corrugations increase noise levels beyond those for smooth rail-wheel interfaces and ultimately the problem can only be cured by grinding or machining the rail and wheel surfaces. This is both time consuming and expensive.

There are a number of lubricants known in the art and some of these are designed to reduce rail and wheel wear on rail roads and rapid transit systems. For example, U.S. Pat. No. 4,915,856 discloses a solid anti-wear, anti-friction lubricant. The product is a combination of anti-wear and anti-friction agents suspended in a solid polymeric carrier for application to the top of a rail. Friction of the carrier against the wheel activates the anti-wear and anti-friction agents. However, the product does not display a positive friction characteristic. Also, the product is a solid composition with poor retentivity.

U.S. Pat. Nos. 5,308,516, 5,173,204 and WO 90/15123 relate to solid friction modifier compositions having high and positive friction characteristics. These compositions display increased friction as a function of creepage, and comprise resins to impart the solid consistency of these formulations. The resins employed included amine and polyamide epoxy resins, polyurethane, polyester, polyethylene or polypropylene resins. However, these require continuous application in a closed loop system for optimal performance.

European Patent application 0 372 559 relates to solid coating compositions for lubrication which are capable of providing an optimum friction coefficient to places where it is applied, and at the same time are capable of lowering abrasion loss. However, the compositions do not have positive friction characteristics. Furthermore, there is no indication that these compositions are optimized for durability or retentivity on the surfaces to which they are applied.

There are several drawbacks associated with the use of compositions of the prior art, including solid stick compositions. First, outfitting railcars with friction modifier stick compositions and applying to large stretches of rail is wasteful if a noise problem exists at only a few specific locations on a track. Second, some railroads have a maintenance cycle that may last as long as 120 days. There is currently no stick technology that will allow solid lubricant or friction modifiers to last this period of time. Third, freight practice in North America is for freight cars to become separated all over the continent, therefore friction modifier sticks are required on many if not all rail cars which would be expensive and impractical. Similarly, top of rail friction management using solid sticks requires a closed system to achieve adequate buildup of the friction modifier product on the rail. A closed system is one where there is essentially a captive fleet without external trains entering or leaving the system. While city transit systems are typically closed, freight systems are typically open with widespread interchange of cars. In such a system, solid stick technology may be less practical.

As many lubricant compositions of the prior art are either formulated into solid sticks or are viscous liquids (pastes), they may not be applied to sliding and rolling-sliding systems as an atomized spray. The application of a liquid friction control composition in an atomized spray, in many instances reduces the amount of the composition to be applied to a rail system and provides for a more even distribution of the friction modifier composition at the required site. Furthermore, atomized sprays dry rapidly which may lead to minimizing the potential for undesired locomotive wheel slip.

Applying liquid-based compositions to the top of the rail has distinct advantages over using a solid stick delivery system applied to the wheels. Using a liquid system allows for site-specific application via a hirail, wayside or onboard system. Such specific application is not possible with the solid delivery system that continually applies product to the wheels. Furthermore the low transference rate of the solid stick application method will not yield any benefits until the track is fully conditioned. This is an unlikely situation for a Class 1 rail line due to the extensive amount of track that must be covered and the presence of rail cars not possessing the solid stick lubricant. Liquid systems avoid this problem as the product is applied to the top of the rail, allowing all axles of the train to come in contact with, and benefit immediately from the product. However, this is not always true as the ability of the applied film to remain adhered to the rail and provide friction control is limited. Under certain conditions liquid products have worn off before a single train pass.

WO 98/13445 (which is incorporated by reference) describes several water-based compositions exhibiting a range of frictional compositions including positive frictional characteristics between two steel bodies in rolling-sliding contact. While exhibiting several desirous properties relating to frictional control, these composition exhibit low retentivity, and do not remain associated with the rail for long periods of time, requiring repeated application for optimized performance. Also, as these compositions are water-based, the lower limit of the temperature range within which they can be used is limited. These compositions are useful for specific applications, however, for optimized performance repeated re-application is required, and there is an associated increase in cost. Furthermore, due to several of the characteristics of these liquid compositions, these compositions have been found to be unsuitable for atomized spray applications. WO 02/26919 (which is incorporated by reference), also discloses water-based friction control agents that comprise retentivity agents to extend the beneficial properties of the composition on a steel surface.

U.S. Pat. Nos. 6,387,854 and 5,492,642 disclose water-based lubricating compositions comprising a polyoxyalkylene glycol lubricant having a MW of about 2,500, a polyoxyalkylene glycol thickener having a MW of about 12,000, and a solvent (e.g. propylene glycol). The disclosed compositions in U.S. Pat. Nos. 6,387,854 and 5,492,642 do not, however, have positive friction characteristics.

While several water-based friction modifiers in the prior art exhibit positive friction characteristics, a limitation of these friction modifiers is their inability to be applied at low temperatures, for example, below −5° C. As friction modifiers must be repeatedly applied to the rail head or flange interface to ensure proper friction control throughout the year, including the winter months, there is a need for friction modifier compositions which exhibit a reduced freezing point. Such compositions may be effectively used in open in either closed or open rail systems throughout the year.

It is an object of the present invention to overcome drawbacks of the prior art and in particular to enhance the retentivity of the friction control compositions.

The above object is met by a combination of the features of the main claims. The sub claims disclose further advantageous embodiments of the invention.

SUMMARY OF THE INVENTION

The invention relates to liquid friction control compositions for applying to surfaces that are in sliding or rolling-sliding contact. More specifically, the present invention relates to friction control compositions for use in a range of temperatures including low temperature conditions.

The present invention provides the friction control composition as defined above, comprising water, a rheological control agent, a consistency modifier, a freezing point depressant, and one or more of a retentivity agent, an antioxidant, a lubricant, and a friction modifier.

The present invention further relates to a liquid friction control composition comprising:

(a) from about 30 to about 55 weight percent water;

(b) from about 0.5 to about 20 weight percent of a rheological control agent;

(c) from about 0.1 to about 20 weight percent of a consistency modifier;

(d) from about 10 to about 30 weight percent of a freezing point depressant, and one or more of (i) from about 0 to about 20 weight percent retentivity agent;

(ii) from about 0 to about 30 weight percent lubricant; and (iii) from about 0.5 to about 30 weight percent friction modifier.

The present invention is also directed to a liquid friction control composition having a high positive frictional (HPF) characteristic, the composition comprising:

(a) from about 30 to about 55 weight percent water;

(b) from about 0.5 to about 20 weight percent of a rheological control agent;

(c) from about 0.1 to about 20 weight percent of a consistency modifier;

(d) from about 10 to about 30 weight percent of a freezing point depressant, (e) from about 0 to about 20 weight percent retentivity agent;

(f) from about 1 to about 30 weight percent lubricant, and (g) from about 0.5 to about 30 weight percent friction modifier.

The present invention is further directed to a liquid friction control composition having a very high positive frictional (VHPF) characteristic, the composition comprising:

(a) from about 30 to about 55 weight percent water;

(b) from about 0.5 to about 20 weight percent of a rheological control agent;

(c) from about 0.1 to about 20 weight percent of a consistency modifier;

(d) from about 10 to about 30 weight percent of a freezing point depressant;

(e) from about 0 to about 20 weight percent retentivity agent, and (f) from about 1 to about 30 weight percent friction modifier.

The present invention is also directed to the friction control compositions described above, wherein the rheological control agent is selected from the group consisting of bentonite; hectorite; caseine; carboxymethylcellulose; carboxy-hydroxymethyl cellulose, cellulose substituted with a substituent selected from the group consisting of methyl, hydroxypropyl, hydroxyethyl, and a mixture thereof; ethoxymethylcellulose; chitosan; a starch; and a mixture thereof.

The present invention further provides a liquid friction control composition having a low coefficient of friction (LCF) characteristic, the composition comprising:

(a) from about 30 to about 55 weight percent water;

(b) from about 0.5 to about 20 weight percent of a rheological control agent selected from the group consisting of bentonite; hectorite; caseine; carboxymethylcellulose; carboxy-hydroxymethyl cellulose, cellulose substituted with a substituent selected from the group consisting of methyl, hydroxypropyl, hydroxyethyl, and a mixture thereof; ethoxymethylcellulose; chitosan; a starch; and a mixture thereof;

(c) from about 0.1 to about 20 weight percent of a consistency modifier;

(d) from about 10 to about 30 weight percent of a freezing point depressant;

(e) from about 0 to about 20 weight percent retentivity agent, and (f) from about 1 to about 30 weight percent lubricant.

The present invention also pertains to of all of the friction control compositions defined above, wherein the rheological control agent is a substituted cellulose compound comprising anhydroglucose units that are each substituted with a substituent selected from the group consisting of a methyl group, a hydroxypropyl group, a hydroxyethyl group, and a mixture thereof. Each of the anhydroglucose units of the substituted cellulose compound is preferably substituted by an average of from about 1.3 to about 1.9 substituents.

The friction control compositions as defined above may further comprise a wetting agent, an antibacterial agent, a defoaming agent, or a combination thereof.

The present invention also relates to a friction control composition as described above, wherein the freezing point depressant is a glycol.

The present invention further embraces a friction control composition as defined above, wherein the consistency modifier is propylene glycol.

The present invention also relates to a friction control composition as described above, wherein the freezing point depressant is a glycol ether or a propylene glycol ether. In a preferred embodiment, the propylene glycol ether is selected from the group consisting of PREGLYDE® DMM, ARCOSOLV® PTB, ARCOSOLV® PMA, ARCOSOLV® PnP, DOWANOL® DPnP and DOWANOL® DPM.

The present invention also provides a friction control composition as described above, wherein the freezing point depressant is an ethylene glycol ether, such as, and without limitation to DOWANOL® EB.

The present invention also provides a friction control composition as defined above, wherein the freezing point depressant is selected from the group consisting of propylene glycol, dipropylene glycol methyl ester, dipropylene glycol dimethyl ether, dipropylene glycol monopropyl ether, propylene glycol tertiary butyl ether, propylene glycol normal propyl ether, dipropylene glycol monopropyl ether, propylene glycol methyl ether acetate, propylene glycol methyl ether acetate, and ethylene glycol butyl ether.

The present invention further provides a friction control composition as defined above, wherein the consistency modifier and the freezing point depressant are both propylene glycol.

The present invention also provides a friction control composition as defined above, wherein the freezing point depressant is a salt, for example, betaine HCl, cesium chloride, potassium chloride, potassium acetate, sodium acetate, potassium chromate, sodium chloride, sodium formate, or sodium tripolyphosphate.

The present invention further provides a friction control composition, as defined above, wherein the freezing point depressant is a composition comprising a metal acetate, such as potassium acetate or sodium acetate. Examples of such compositions include without limitation, CRYOTECH® E36, which comprises potassium acetate, and CRYOTECH® NAAC, which comprises sodium acetate.

The present invention even further provides a friction control composition, as defined above, wherein the freezing point depressant is an acid, such as, citric acid, lactic acid, or succinic acid, a heterocyclic amine, such as nicotinamide, an aryl alcohol, such as phenol, an amino acid, an amino acid derivative, such as trimethyl glycine, or a carbohydrate, such as D-xylose.

The present invention also provides a friction control composition as defined above, wherein the freezing point depressant reduces the freezing point of the composition by at least 1° C., more preferably by at least 10° C., most preferably by at least 15° C., relative to that of the same composition lacking the freezing point depressant.

Furthermore, the present invention pertains to friction control compositions as defined above, wherein the retentivity agent is selected from the group consisting of acrylic, polyvinyl alcohol, polyvinyl chloride, oxazoline, epoxy, alkyd, modified alkyd, acrylic latex, acrylic epoxy hybrids, polyurethane, styrene acrylate, and styrene butadiene based compounds. It is preferred that the fetentivity agent is a styrene butadiene compound and the antioxidant is a mixture of a thioester type antioxidant and a hindered phenol type antioxidant. More preferably, the retentivity agent is DOW LATEX 226® and the antioxidant is OCTOLITE® 24-50.

The present invention also relates to friction control compositions as defined above, which further comprise from about 0.5 to about 2 weight percent antioxidant. In a preferred embodiment, the antioxidant is selected from the group consisting of a styrenated phenol type antioxidant; an amine type antioxidant, a hindered phenol type antioxidant; a thioester type antioxidant, and a combination thereof.

Furthermore, the antioxidant may be selected from the group consisting of a styrenated phenol type antioxidant; an amine type antioxidant, a hindered phenol type antioxidant; a thioester type antioxidant, and a combination thereof. The retentivity agent may be selected from the group consisting of acrylic, polyvinyl alcohol, polyvinyl chloride, oxazoline, epoxy, alkyd, urethane acrylic, modified alkyd, acrylic latex, acrylic epoxy hybrids, polyurethane, styrene acrylate, and styrene butadiene based compounds.

In another aspect, the present invention provides a method of controlling noise between two steel surfaces in sliding-rolling contact comprising applying liquid friction control composition as defined above to at least one of said two steel surfaces. This invention also includes a the above method wherein in the step of applying, the liquid control composition is sprayed onto said at least one of two steel surfaces.

In a further aspect, the present invention provides the use of an antioxidant to enhance the retentivity of the friction control composition to a steel surface. This enhanced retentivity due to the antioxidant occurs whether or not a retentivity agent is present in the friction control composition. One advantage of increasing the retentivity of the friction control composition is that it increases the lifetime of operation or the durability of the friction control compositions.

The present invention also pertains to a method of reducing lateral forces between two steel surfaces in sliding-rolling contact comprising applying liquid friction control composition HPF and LCF defined above to at least one of the two steel surfaces.

The present invention embraces a method of reducing drawbar pull between two or more train cars, the method comprising applying the liquid friction control compositions HPF and LCF defined above to a surface of one or more wheels of the train cars, or the rail surface over which the train cars travel.

The present invention is directed to enhanced compositions that control the friction between two steel bodies in sliding-rolling contact. The compositions of the present invention are particularly useful for low temperature applications, where freezing points of less than −5° C. or −10° C. are required. If desired, an additional advantage of the friction control compositions of the present invention, which contain a retentivity agent, pertains to an increased retentivity of the composition between the two surfaces, when compared with prior art compounds that readily rub or burn off the applied surfaces during use.

The compositions of the present invention exhibit properties that are well adapted for a variety of application techniques that minimizes the amount of composition that needs to be applied. By using these application techniques administration of accurate amounts of composition may be obtained. For example, liquid compositions are suited for spraying onto a surface thereby ensuring a uniform coating of the surface and optimizing the amount of composition to be applied. Compositions may be applied from a wayside applicator ensuring a reduced amount of friction controlling composition to be applied to the surface. Furthermore, by combining application techniques, or locations of applicators, combinations of compositions may be applied to different surfaces that are in sliding-rolling contact to optimize wear, and reduce noise and other properties, for example lateral forces, and drawbar pull.

This summary does not necessarily describe all necessary features of the invention but that the invention may also reside in a sub-combination of the described features.

DESCRIPTION OF PREFERRED EMBODIMENT

The invention relates to friction control compositions for applying to surfaces which are in sliding or rolling-sliding contact. More specifically, the present invention relates to friction control compositions for use in a range of temperatures including low temperature conditions.

The following description is of a preferred embodiment by way of example only and without limitation to the combination of features necessary for carrying the invention into effect.

The friction control compositions of the present invention generally comprise a rheological control agent, a consistency modifier, and a freezing point depressant, and one or more of a friction modifier, or a lubricant. Other optional components that can be included in the composition of the present invention include a retentivity agent, an antioxidant, a wetting agent, and a preservative. If a liquid formulation is desired, the friction control composition of the present invention may also comprise water or another composition-compatible solvent. Even though the compositions of the present invention, when comprising water or other compatible solvent, are effective for use within liquid formulations, the composition may be formulated into a paste and these compositions exhibit many of the advantages of the frictional composition described herein. The compositions as described herein may also comprise wetting agents, dispersants, anti-bacterial agents, and the like as required.

By the term 'positive friction characteristic', it is meant that the coefficient of friction between two surfaces in sliding or rolling-sliding contact increases as the creepage between the two surfaces increases. The term 'creepage' is a common term used in the art and its meaning is readily apparent to someone of skill in the art. For example, in the railroad industry, creepage may be described as the percentage difference between the magnitude of the velocity of the sliding movement of a rail relative to the magnitude of the tangential velocity of the wheel at the point of contact between wheel and rail, assuming a stationary zone of contact and a dynamic rail and wheel.

Various methods in the art may be used to determine if a friction control composition exhibits a positive friction characteristic. For example, but not wishing to be limiting, in the lab a positive friction characteristic may be identified using a disk rheometer or an Amsler machine ((H. Harrison, T. McCanney and J. Cotter (2000), Recent Developments in COF Measurements at the Rail/Wheel Interface, Proceedings The 5$^{th}$ International Conference on Contact Mechanics and Wear of Rail/Wheel Systems CM 2000 (SEIKEN Symposium No. 27), pp. 30–34, which is incorporated herein by reference). An Amsler machine consists of two parallel discs being run by each other with variable loads being applied against the two discs. This apparatus is designed to simulate two steel surfaces in sliding-rolling contact. The discs are geared so that the axle of one disc runs about 10% faster than the other. By varying the diameter of the discs, different creep levels can be obtained. The torque caused by friction between the discs is measured and the coefficient of friction is calculated from the torque measurements. In determining the friction characteristic of a friction modifier composition it is preferable that the friction control composition be fully dry prior to performing measurements for friction characteristics. However, measurements using wet or semi-dry friction control compositions may provide additional information relating to the friction control compositions. Similarly, creep characteristics may be determined using a train with specially designed bogies and wheels that can measure forces acting at the contact patch between the rail and wheel, and determine the creep rates in lateral and longitudinal direction simultaneously.

As would be evident to some skilled in the art, other two roller systems may be used to determine frictional control characteristics of compositions (e.g. A. Matsumo, Y. Sato, H. Ono, Y. Wang, M. Yamamoto, M. Tanimoto and Y. Oka (2000), Creep force characteristics between rail and wheel on scaled model, Proceedings The 5$^{th}$ International Conference on Contact Mechanics and Wear of Rail/Wheel Systems CM 2000 (SEIKEN Symposium No. 27), pp. 197–202; which is incorporated herein by reference). Sliding friction characteristics of a composition in the field, may be determined using for example but not limited to, a push tribometer or TriboRailer (H. Harrison, T. McCanney and J. Cotter (2000), Recent Developments in COF Measurements at the Rail/Wheel Interface, Proceedings The 5$^{th}$ International Conference on Contact Mechanics and Wear of Rail/Wheel Systems CM 2000 (SEIKEN Symposium No. 27), pp. 30–34, which is incorporated herein by reference).

In a graphical representation of a typical coefficient of friction versus % creep curve, as determined using an amsler machine, for a composition characterized as having a neutral friction characteristic (LCF), with increased creepage, there is a low coeffecient of friction. As described herein, LCF can be characterized as having a coefficient of friction of less than about 0.2 when measured with a push tribometer. Preferably, under field conditions, LCF exhibits a coefficient of friction of about 0.15 or less. A positive friction characteristic is one in which friction between the wheel and rail systems increases as the creepage of the system increases. As described herein, HPF can be characterized as having a coefficient of friction from about 0.28 to about 0.4 when measured with a push tribometer. Preferably, under field conditions, HPF exhibits a coefficient of friction of about 0.35. VHPF can be characterized as having a coefficient of friction from about 0.45 to about 0.55 when measured with a push tribometer. Preferably, under field conditions, VHPF exhibits a coefficient of friction of 0.5.

Wheel squeal associated with a curved track may be caused by several factors including wheel flange contact with the rail gauge face, and stick-slip due to lateral creep of the wheel across the rail head. Without wishing to be bound by theory, lateral creep of the wheel across the rail head is thought to be the most probable cause of wheel squeal, while wheel flange contact with the rail gauge playing an important, but secondary role. Studies, as described herein, demonstrate that different friction control compositions may be applied to different faces of the rail-wheel interface to effectively control wheel squeal. For example, a composition with a positive friction characteristic may be applied to the head of the rail-wheel interface to reduce lateral slip-stick of the wheel tread across the rail head, and a low friction modifier composition may be applied to the gauge face of the rail-wheel flange to reduce the flanging effect of the lead axle of a train car.

By the term 'rheological control agent' it is meant a compound capable of absorbing liquid, for example but not limited to water, and physically swell. A rheological control agent may also function as a thickening agent, and help keep the components of the composition in a dispersed form. This agent functions to suspend active ingredients in a uniform manner in a liquid phase, and to control the flow properties and viscosity of the composition. This agent may also function by modifying the drying characteristics of a friction modifier composition. Furthermore, the rheological control agent may provide a continuous phase matrix capable of maintaining the solid lubricant in a discontinuous phase matrix. Rheological control agents include, but are not limited to clays such as be tonite (montmorillonite) and hectorite, for example but not limited to HECTABRITE®; RHEOLATE® 244 (a urethane); caseine; carboxymethylcellulose (CMC, e.g. CELFLOW®); carboxyhydroxymethyl cellulose; a substituted cellulose compound comprising anhydroglucose units that are each substituted with a substituent selected from the group consisting of a methyl group, a hydroxypropyl group, a hydroxyethyl group, and a mixture thereof; ethoxymethylcellulose, chitosan, a starch, and a mixture thereof. Non-limiting examples of substituted cellulose compounds comprising anhydroglucose units include METHOCEL® (Dow Chemical Company), METOLOSE® (ShinEtsu), MECELLOSE® HPMC (Samsung) and HBR (an hydroxyethylcellulose).

In a preferred embodiment, the rheological control agent is a substituted cellulose compound comprising anhydroglucose units that are each substituted with a substituent selected from the group consisting of a methyl group, a hydroxypropyl group, a hydroxyethyl group, and a mixture thereof. In another preferred embodiment, each of the anhydroglucose units of the substituted cellulose compound is substituted by an average of about 1.3 to about 1.9 substituents.

By the term 'consistency modifier' it is meant any material that allows the friction control compositions of the present invention to be formulated with a desired consistency. Examples of the consistency modifier include, without limitation, glycerine, alcohols, glycols such as propylene glycol or combinations thereof. In addition, the consistency modifier may alter other properties of the friction control compositions, such as the low temperature properties of the compositions, and function in some degree as a freezing point depressant, thereby allowing the friction control compositions of the present invention to be formulated for operation under varying temperatures.

By the term 'freezing point depressant' it is meant any material that when added to the composition of the present invention results in a reduction in the freezing point of the composition relative to that of the same composition lacking the freezing point depressant for example by reducing the freezing point of the composition by at least 1° C., or by at least 10° C., or by at least 15° C., relative to that of the same composition lacking the freezing point depressant. A freezing point depressant may be added to the composition of the present invention in addition to a consistency modifier.

A non-limiting example of the freezing point depressant include a glycol, such as propylene glycol, or a glycol ether, more particularly, a propylene glycol ether, or an ethylene glycol ether, such as and without limitation to DOWANOL® EB (ethylene glycol butyl ether). The freezing point depressant may also be selected from the group consisting of dipropylene glycol methyl ester, dipropylene glycol dimethyl ether, dipropylene glycol monopropyl ether, propylene glycol tertiary butyl ether, propylene glycol normal propyl ether, dipropylene glycol monopropyl ether, propylene glycol methyl ether acetate, propylene glycol methyl ether acetate, and ethylene glycol butyl ether. However, it is to be understood that this group is to be considered non-limiting.

The freezing point depressant can also be a salt, for example, betaine HCl, cesium chloride, potassium chloride, potassium acetate, sodium acetate, potassium chromate, sodium chloride, sodium formate, or sodium tripolyphosphate.

Furthermore, the freezing point depressant can be a composition comprising a metal acetate, such as potassium acetate or sodium acetate. Examples of such compositions include without limitation, CRYOTECH® E36, which comprises potassium acetate, and CRYOTECH® NAAC, which comprises sodium acetate.

The freezing point depressant may also be an acid, such as, citric acid, lactic acid, or succinic acid, a heterocyclic amine, such as nicotinamide, an aryl alcohol, such as phenol, an amino acid, an amino acid derivative, such as trimethyl glycine, or a carbohydrate, such as D-(+)-xylose.

To prevent appreciable slippage of a train on a rail treated with the HPF or VHPF compositions of the present invention, it is preferred that the solvent component of these compositions, which, in some cases, includes both a liquid consistency modifier and a liquid freezing point depressant, (i) evaporate soon after the compositions are applied to the rail, or (ii) readily evaporate, dehydrate or decompose under the pressure and heat generated by the wheels of the train contacting the treated rail, or both (i) and (ii). In some compositions of the present invention, which include a lubricant component, for example, HPF and LCF compositions, the presence of a freezing point depressant component, which imparts a lubricating property to the composition, may be acceptable, and the freezing point depressant component, need not be readily removable from the composition by evaporation, dehydration or decomposition. It is desired that a freezing point depressant be characterized as having a high flash point, for example at or above 93° C. However, freezing point depressants with a lower flash point may also be sued as described herein.

In Example 10, several non-limiting, candidate liquid freezing point depressants are evaluated using an Amsler machine to estimate the time required for each of them to evaporate, dehydrate or decompose from the surface of a pair of metal discs, under conditions that simulated those present at the interface of the wheels of a moving locomotive and a rail. In this example, liquid freezing point depressants that demonstrated relatively rapid removal times from the metal surface of the discs were judged to be suitable for use in the friction control compositions exhibiting a positive friction characteristic, for example, HPF and VHPF compositions. However, it to be understood that these compositions may also be used in LCF compositions as well. By a relatively rapid removal time, it is meant a removal time less than that of propylene glycol (1,2 propanediol). Under the conditions used in Example 10, a coefficient of friction of 0.4 is attained with propylene glycol at about 2,500 sees (see Table 15, Example 10). Therefore, freezing point depressants having a removal time of about 2,500 sec or less, when tested using the apparatus and conditions defined in Example 10, may be used in VHPF, HPF and LCF compositions.

Conversely, freezing point depressants that demonstrated relatively longer removal times from the metal surface of the discs, that is removal times greater than about 2500 sec, as determined using the conditions defined in Example 10, may be suitable for use in the friction control compositions comprising a lubricant, for example, LCF and HPF compositions.

The removal times of the freezing point depressants tested in Example 10 were found to correlate with their vapor pressure values. This correlation suggests that vapor pressure may also be used to determine whether a candidate liquid freezing point depressant is suitable for use in the friction control compositions, for example, VHPF, HPF or LCF compositions, of the present invention. For example, the vapour pressure of propylene glycol is about 0.129 (at 20° C.; see Table 15, Example 10), therefore, liquid freezing point depressants that are characterized as having a vapour pressure of about 0.1 (at 20° C.) or greater, may be used in the friction control compositions exhibiting a positive friction characteristic, for example, HPF and VHPF compositions, as well as LCF compositions. Likewise, freezing point depressants that are characterized as having a vapour pressure of less than about 0.1 (at 20° C.) may be suitable for use in the friction control compositions comprising a lubricant, for example, LCF and HPF compositions.

Freezing point depressants that demonstrate relatively rapid removal times from the metal surface of the discs, or as having a vapour pressure of greater than 0.1 (at 20 C.), may be suitable for use in the friction control compositions exhibiting a positive friction characteristic, for example, HPF, VHPF and LCF compositions. Non-limiting examples of suitable freezing point depressants that exhibit a rapid removal time include ARCOSOLV® PMA (a dipropylene glycol methyl ether acetate), ARCOSOLV® PTB (a dipropylene glycol tertiary butyl ether), ARCOSOLV® PnP (a dipropylene glycol normal propyl ether), ARCOSOLV® PNB propylene glycol normal butyl ether), PROGLYDE® DMM (a dipropylene glycol dimethyl ether), DOWANOL® DPM (a dipropylene glycol methyl ether), DOWANOL® DPnP (a dipropylene glycol monopropyl ether), and propylene glycol.

Non-limiting examples of freezing point depressants that demonstrated relatively longer removal times from the metal of the discs, or vapour pressures less than 0.1 (at 20° C.) and that may be used in friction control compositions comprising a lubricant, for example, LCF and HPF compositions, include hexylene glycol, DOWANOL® DPnB (dipropylene glycol butoxy ether) and ARCOSOLV® TPM (tripropylenen glycol methyl ether).

It is to be understood that combinations of freezing point depressants may also be used in the compositions described herein, as synergistic effects, of reduced freezing points, were observed when two or more freezing point depressants were mixed together (see Table 16 and 17, Example 11).

For example, a composition comprising propylene glycol at 7% (w/w) exhibits a freezing point of about −3° C., and a composition comprising DOWANOL® DPM at 23.5 % (w/w) exhibits a freezing point of about −6° C. However, compositions comprising both propylene glycol (at 7% w/w) and DOWANOL® DPM (at 23.5% w/w) exhibited a freezing point of −24.5° C. (see Table 16, Example 11). A composition comprising either propylene glycol or DOWANOL® DPM on its own at 30.5 %(w/w, the total amount of propylene glycol and DOWANOL® DPM) exhibits a freezing point of only −15° C., or −9° C., respectively.

Similarly, a composition comprising propylene glycol at 14.83% (w/w) exhibits a freezing point of about −4° C., and a comprising PROGLYDE® DMM at 19.0% (w/w) exhibits a freezing point of about −3° C. A composition comprising both propylene glycol (at 14.83% w/w) and PROGLYDE® DMM (at 19.0% w/w) exhibited a freezing point of −28.0° C. (see Table 16, Example 11). However, a composition comprising propylene glycol or PROGLYDE® DPM on its own at 33.83.0% (w/w, the total amount of propylene glycol and DOWANOL® DPM ) exhibits a freezing point of only −20° C., or −10° C., respectively. Similar synergistic results were observed with other combinations of freezing point depressants.

By the term 'friction modifier' it is meant a material which imparts a positive friction characteristic to the friction control composition of e present invention, or one which enhances the positive friction characteristic of a liquid friction control composition when compared to a similar composition which lacks a friction modifier. The friction modifier preferably comprises a powderized mineral and has a particle size in the range of about 0.5 microns to about 10 microns. Further, the friction modifier may be soluble, insoluble or partially soluble in water and preferably maintains a particle size in the range of about 0.5 microns to about 10 microns after the composition is deposited on a surface and the liquid component of the composition has evaporated. Friction modifiers, described in U.S. Pat. No. 5,173,204 and WO98/13445 (which are incorporated herein by reference) may be used in the composition described herein. Friction modifiers may include, but are not limited to:

Whiting (Calcium Carbonate);

Magnesium Carbonate;

Talc (Magnesium Silicate);

Bentonite (Natural Clay);

Coal Dust (Ground Coal);

Blanc Fixe (Calcium Sulphate);

Asbestors (Asbestine derivative of asbestos);

China Clay; Kaolin type clay (Aluminium Silicate);

Silica—Amorphous (Synthetic);

Naturally occurring Slate Powder;

Diatomaceous Earth;

Zinc Stearate;

Aluminium Stearate;

Magnesium Carbonate;

White Lead (Lead Oxide);

Basic Lead Carbonate;

Zinc Oxide;

Antimony Oxide;

Dolomite (MgCo CaCo);

Calcium Sulphate;

Barium Sulphate (e.g. Baryten);

Polyethylene Fibres;

Aluminum Oxide;

Magnesium Oxide; and

Zirconium Oxide or combination thereof.

By the term 'retentivity agent' it is meant a chemical, compound or combination thereof which increases the effective lifetime of operation or the durability of a friction control composition between two or more surfaces is sliding-rolling contact. A retentivity agent provides, or increases film strength and adherence to a substrate. Preferably a retentivity agent is capable of associating with components of the friction composition and forming a film on the surface to which it is applied, thereby increasing the durability of the composition on the surface exposed to sliding-rolling contact. Typically, a retentivity agent exhibits the desired properties (for example, increased film strength and adherence to substrate) after the agent has coalesced or polymerized as the case may be. It may be desireable under some condition.

It is preferable that a retentivity agent has the ability to bind the lubricant and friction modifier components so that these components form a thin layer and resist displacement from the wheel-rail contact patch. It is also preferable that retentivity agents maintain physical integrity during use and are not burned off during use. Suitable retentivity agents exhibit a high solids loading capacity, reduced viscosity, and if desired a low minimum film forming temperature. Examples of retentivity agents, include but are not limited to:

acrylics, for example but not limited to, RHOPLEX® AC 264, RHOPLEX® MV-23LO or MAINCOTE® HG56 (Rohm & Haas);

polyvinyls, for example, but not limited to, AIRFLEX® 728 (Air Products and Chemicals), EVANOL® (Dupont), ROVACE® 9100, or ROVACE® 0165 (Rohm & Haas);

oxazolines, for example, but not limited to, AQUAZOL® 50 & 500 (Polymer Chemistry);

styrene butadiene compounds, for example for example but not limited to, DOW LATEX 226 & DOW LATEX 240® (Dow Chemical Co.);

styrene acrylate, for example but not limited to, ACRONAL® S 760 (BASF), RHOPLEX® E-323LO RHOPLEX® HG-74P (Rohm & Hass), EMULSION® E-1630, E-3233 (Rohm & Hass);

epoxies, comprising a two part system of a resin and a curing agent. Choice of resin may depend upon the solvent used for the friction modifier composition. For example, which is not to be considered limiting, in aqueous formulations suitable resin include water borne epoxies, such as, ANCARES® AR 550 (is 2,2'-[(1-methylethylidene)bis(4,1-phenyleneoxymethylene)]bisoxirane homopolymer; Air Products and Chemicals), EPOTUF® 37-147 (Bisphenol A-based epoxy; Reichhold). An amine or amide curing agents, for example, but not limited to ANQUAMINE® 419, 456 and ANCAMINE® K54 (Air Products and Chemicals) may be used with aqueous epoxy formulations. However, increased retentivity has been observed when an epoxy resin, in the absence of a curing agent is used alone. Preferably, the epoxy resin is mixed with a curing agent during use. Other components that may be added to the composition include hydrocarbon resins that increase the adhesion of the composition to contaminated surfaces, for example, but not limited to, EPODIL-L® (Air Products Ltd.) If an organic based solvent is used, then non-aqueous epoxy resins and curing agents, may be used;

alkyd, modified alkyds;

acrylic latex;

acrylic epoxy hybrid;

urethane acrylic;

polyurethane dispersions; and various gums and resins.

Increased retentivity of a friction modifier composition comprising a retentivity agent, is observed in compositions comprising from about 0.5 to about 40 weight percent retentivity agent. Preferably, the composition comprises about 1 to about 20 weight percent retentivity agent.

As an epoxy is a two-part system, the properties of this retentivity agent may be modulated by varying the amount of resin or curing agent within the epoxy mixture. For example, which is described in more detail below, increased retentivity of a friction modifier composition comprising an epoxy resin and curing agent, is observed in compositions comprising from about 1 to about 50 wt % epoxy resin. Preferably, the composition comprises from about 2 to about 20 wt % epoxy resin. Furthermore, increasing the amount of curing agent, relative to the amount of resin, for example, but not limited to 0.005 to about 0.8 (resin:curing ratio), may also result in increased retentivity. As described below, friction modifier compositions comprising epoxy resin in the absence of curing agent, also exhibit high retentivity. Without wishing to bound by theory, it is possible that without a curing agent the applied epoxy film maintains an elastic quality allowing it to withstand high pressures arising from steel surfaces in sliding and rolling contact.

Retentivity of a composition may be determined using an Amsler machine or other suitable device as referred to above, and noting the number of cycles that an effect is maintained. Furthermore, in the railroad industry retentivity may be measured as a function of the number of axle passes for which a desired effect, such as, but not limited to sound reduction, drawbar force reduction, lateral force reduction, or frictional level, is maintained, or by using a push tribometer. Without being bound by theory, it is thought that retentivity agents possess the ability to form a durable film between surfaces in sliding and rolling-sliding contact, such as but not limited to wheel-rail interfaces.

A solvent may also be used so that the friction modifying compositions of the present invention may be mixed and applied to a substrate. The solvent may be either organic or aqueous depending upon the application requirements, for example, cost of composition, required speed of drying, environmental considerations etc. Organic solvents may include, but are not limited to, methanol, however, other solvents may be used to reduce drying times of the applied composition, increase compatibility of the composition with contaminated substrates, or both decrease drying times and increase compatibility with contaminated substrates. Preferably the solvent is water. Usually in water-borne systems the retentivity agent is not truly in a solution with the solvent, but instead is a dispersion.

By the term 'lubricant' it is meant a chemical, compound or mixture thereof which is capable of reducing the coefficient of friction between two surfaces in sliding or rolling-sliding contact. Lubricants include but are not limited to molybdenum disulfide, graphite, aluminum stearate, zinc stearate and carbon compounds such as, but not limited to coal dust, and carbon fibres. Preferably, the lubricants, if employed, in the compositions of the present invention are molybdenum disulfide, graphite and TEFLON® (polytetrafluoroethylene).

By the term 'antioxidant', it is meant a chemical, compound or combination thereof that either in the presence or absence of a retentivity agent increases the amount of friction control composition retained on the surfaces thereby resulting in an increase in the effective lifetime of operation or durability of the friction control compositions. Antioxidants include but are not limited to:

- amine type antioxidants, for example but not limited to WINGSTAY® 29;
- styrenated phenol type antioxidants, for example but not limited to WINGSTAY® S;
- hindered type antioxidants, for example but not limited to WINGSTAY® L;
- thioester type antioxidants (also known as secondary antioxidants), for example but not limited to WINGSTAY® SN-1; or combinations thereof, for example but not limited to:

- synergistic blends comprising a hindered phenol and a thioester, for example but not limited to OCTOLITE® 424-50.

Preferred antioxidants are WINGSTAY® S, WINGSTAY® L, and WINGSTAY® SN-1, from Goodyear Chemicals, and OCTOLITE® 424-50 from Tiarco Chemical.

The friction control compositions of the present invention may also include other components, such as but not limited to preservatives, wetting agents, consistency modifiers, neutralizing agents, and defoaming agents, either alone or in combination.

Non-limiting examples of preservatives include, but are not limited to ammonia, alcohols or biocidal agents, for example but not limited to OXABAN® A. A non-limiting example of a neutralizing agent is AMP-95® (a solution of 2-amino-2-methyl-1-propanol). Non-limiting examples of a defoaming agent include COLLOIDS 648®, or COLLOIDS 675®.

A wetting agent which may be included in the compositions of the present invention may include, but is not limited to, nonyl phenoxypolyol, or CO-630® (Union Carbide). The wetting agent may facilitate the formation of a water layer around the lubricant and friction modifier particles within the matrix of the rheological control agent, friction modifier and lubricant. A wetting agent may aid in the dispersion of the retentivity agent in the liquid friction control composition. The wetting agent may also be capable of emulsifying grease, which may be present between surfaces in sliding and rolling-sliding contact, for example, but not wishing to be limiting surfaces such as a steel-wheel and a steel-rail. The wetting agent may also function by controlling dispersion and minimizing agglomeration of solid particles within the composition.

As indicated in WO 02/26919 (which is incorporated by reference), a benefit associated with the use of friction control compositions having improved retentivity is the reduction of lateral forces associated with steel-rail and steel-wheel systems of freight and mass transit systems. The reduction of lateral forces may reduce rail wear (gauge widening) and reduce rail replacement costs. Lateral forces may be determined using a curved or tangential track rigged with appropriate strain gauges. Yet another benefit associated with the use of the friction control compositions having improved retentivity is the reduction of energy consumption as measured by, for example but not limited to, drawbar force, associated with steel-rail and steel-wheel systems of freight and mass transit systems. The reduction of energy consumption has an associated decrease in operating costs.

There are several methods of applying a water-based product to the top of the rail. For example which are not to be considered limiting, such methods include: onboard, wayside (also termed trackside) or hirail system. An onboard system sprays the liquid from a tank (typically located after the last driving locomotive) onto the rail. The wayside (trackside), is an apparatus located alongside the track that pumps product onto the rail after being triggered by an approaching train. A hirail is a modified pickup truck that has the capability of driving along the rail. The truck is equipped with a storage tank (or tanks), a pump and an air spray system that allows it to apply a thin film onto the track. The hirail may apply compositions when and where it is needed, unlike the stationary automated wayside. Only a few hirail vehicles are required to cover a large area, whereas the onboard system requires that at least one locomotive per train be equipped to dispense the product.

If the friction control composition of the present invention is for use as an Onboard (sprayable) composition, then the composition may have a viscosity of up to about 7,000 cP (at 25° C.), or from about 1,000 to about 5,000 cP (at 25° C.). However, a viscosity below 1,000 cP may be used as required. If a lower viscosity is used, it may be desired that the viscosity is such that the contents of the composition are keep in solution. Alternatively, the composition may be agitated to keep the components in solution. If the friction control composition is for use as a Trackside composition, then the composition may have a viscosity of from about 5,000 to about 200,000 cP (at 25° C.), or from about 7,000 to about 30,000 cP (at 25° C.). However, viscosities above 200,000 cP may be acceptable, for example a paste, provided that the final composition is pumpable, and flows. The viscosity of a composition according to the present invention can be adjusted by changing the amounts of the components that constitute the compositions of the present invention as would be known to one of skill in the art.

The viscosity of the compositions of the present invention may be determined using any method known in the art, for example using a Brookfield LVDV-E model viscometer. The DV model rotates a spindle (which is immersed in the test fluid) through a calibrated spring. The viscous drag of the fluid against a spindle is measured by the spring deflection. Spring deflection is measured with a rotary transducer which provides a torque signal. The measurement range of a DV (in cPs) is determined by the rotational speed of the spindle, the size and shape of the spindle, the container in which the spindle is rotating, and the full scale torque of the calibrated spring.

The effect of the retentivity agent in prolonging the effectiveness of the compositions of the present invention is maximized if the friction modifier composition is allowed to set after its application for as long as possible prior to its use. However, this length of time may vary under field conditions. In field studies where friction modifier compositions as described herein, were applied to a track, and lateral forces were measured on cars passing over the treated track during and after application, following an initial decrease in lateral force, an increase in lateral force was observed after about 1,200 axle passes. However, if the composition is allowed to set prior to use, reduced lateral forces were observed for about 5,000 to about 6,000 axle passes. Therefore, in order to decrease the setting time of the liquid frictional compositions as described herein, any compatible solvent, including but not limited to water, that permits a uniform application of the composition, and that readily dries may be used in the liquid compositions of the present invention. Furthermore, the present invention contemplates the use of fast drying or rapid curing film forming retentivity agents, for example, epoxy-based film forming retentivity agents to decrease the required setting time of the composition. Such epoxy based compositions have also been found to increase film strength. Prolonging the effectiveness of the compositions of the present invention may also be enhanced by adding one or more antioxidants to the composition, as described in more detail below. Additionally, if rapid set times are required, then freezing point depressants characterized as having a vapour pressure above 0.1 (at 20° C.) may also be used.

The retentivity of the friction control composition may be further enhanced if an antioxidant is added to the composition. The addition of the antioxidant in the system increased the number of cycles obtained before consumption of the composition. A lower consumption rate is indicative of longer retentivity. Non-limiting examples of anti-oxidants include, without limitation, WINGSTAY® S (a styrenated antioxidant), WINGSTAY® L (a hindered antioxidant), WINGSTAY® SN-1 (a thioester antioxidant), and 424-50 (a synergist antioxidant). Other antioxidants may also be added to the frictional control compositions with the effect of increasing retentivity of the composition. A lowering of the consumption rate of various compositions was observed in the presence of the antioxidants.

Without wishing to be bound by theory, it is postulated that the enhanced retentivity of the friction control composition obtained when an antioxidant is added is due to its ability to inhibit oxidation of the retentivity agents, for example, but not limited to the acrylic polymer, RHOPLEX® AC-264 (Example 8, Table 13), and the styrene-butadiene random copolymer, DOW LATEX 226NA®. Both of these retentivity agents may be damaged by oxidation which occurs upon exposure of the retentivity agent to oxygen in the atmosphere. This oxidation may be notably increased in a high temperature environment such as wheel-rail interfaces.

Enhanced retentivity is also observed for compositions comprising an antioxidant, but having no retentivity agent. This enhanced retentivity for compositions where there is no retentivity agent is observed for a range of antioxidants, which includes an amine antioxidant, for example, but not limited to WINGSTAY®29, a styrenated antioxidant, for example, but not limited to WINGSTAY® S, a hindered antioxidant, for example, but not limited to WINGSTAY® L, a thioester antioxidant, for example, but not limited to WINGSTAY® SN-1 and a synergist antioxidant, for example, but not limited to OCTOLITE® 424-50. In all cases, there is lowering of the consumption rate of the composition. Without wishing to be bound by theory, it is postulated that this can be attributed to the protection of the $MoS_2$ from oxidation. In the presence of oxygen, $MoS_2$ can be converted to $MoO_3$. $MoO_3$ is known to have a high coefficient of friction and although this may not affect the polymer film, retentivity may be reduced. The antioxidant will complete with the $MoS_2$ for atmospheric oxygen and therefore the higher the concentration of the antioxidant, the lower the consumption rate of $MoS_2$.

According to one aspect of the present invention there is provided a liquid friction control composition comprising:

(a) from about 30 to about 55 weight percent water;

(b) from about 0.5 to about 20 weight percent of a rheological control agent;

(c) from about 0.1 to about 20 weight percent of a consistency modifier;

(d) from about 10 to about 30 weight percent of a freezing point depressant, and one or more of (d) from about 0 to about 20 weight percent retentivity agent;

(e) from about 0 to about 30 weight percent lubricant; and (f) from about 0.5 to about 30 weight percent friction modifier.

According to a further aspect of the present invention there is provided a liquid friction control composition exhibiting a high positive frictional (HPF) characteristic, the composition comprising:

(a) from about 30 to about 55 weight percent water;

(b) from about 0.5 to about 20 weight percent of a rheological control agent;

(c) from about 0.1 to about 20 weight percent of a consistency modifier;

(d) from about 10 to about 30 weight percent of a freezing point depressant;

(e) from about 0 to about 20 weight percent retentivity agent;

(f) from about 1 to about 30 weight percent lubricant, and (g) from about 0.5 to about 30 weight percent friction modifier.

Optionally this composition may also comprise antibacterial agents, defoaming agents and wetting agents.

According to another aspect of the present invention there is provided a liquid friction control composition characterized as having a very high positive friction (VHPF) characteristic, the composition comprising.

(a) from about 30 to about 55 weight percent water;

(b) from about 0.5 to about 20 weight percent of a rheological control agent;

(c) from about 0.1 to about 20 weight percent of a consistency modifier;

(d) from about 10 to about 30 weight percent of a freezing point depressant;

(e) from about 0 to about 20 weight percent retentivity agent, and (f) from about 1 to about 30 weight percent friction modifier.

Optionally, this composition may also comprise antibacterial agents, defoaming agents and wetting agents.

According to yet another aspect of the present invention, there is provided a liquid friction control composition having a low coefficient of friction (LCF), the composition comprising:

(a) from about 30 to about 55 weight percent water;

(b) from about 0.5 to about 20 weight percent of a rheological control agent;

(c) from about 0.1 to about 20 weight percent of a consistency modifier;

(d) from about 10 to about 30 weight percent of a freezing point depressant;

(e) from about 0 to about 20 weight percent retentivity agent, and (f) from about 1 to about 30 weight percent lubricant.

Optionally, this composition may also comprise antibacterial agents, defoaming agents and wetting agents.

The friction control compositions of the present invention can be used for modifying friction on surfaces that are in sliding or rolling-sliding contact, such as railway wheel flanges, or rail gauge faces. However, it is also contemplated that the friction control compositions of the present invention may be used to modify friction on other metallic, non-metallic or partially metallic surfaces that are in sliding or rolling-sliding contact, for example but not limited to fifth-wheel applications.

The compositions of the present invention may be applied to metal surfaces such as rail surfaces or couplings by any method known in the art. For example, but not wishing to be limiting, the compositions of the present invention may be applied in the form of a suspension, gel or paste, or as a bead of any suitable diameter, for example about one-eighth of an inch in diameter.

A composition of the present invention can be produced in the form of a gel, for example, by using a freezing point depressant, such as PROGLYDE® DMM, together with a rheological control agent having a relatively low degree of substitution, such as METHOCEL® K4M, a substituted cellulose compound comprising anhydroglucose units that are each substituted by an average of about 1.4 substituents. Without wishing to be bound by theory, the gellation of the composition is caused by the swelling of the rheological control agent with the freezing point depressant. The degree of gellation of such a composition can be decreased by either, replacing the freezing point depressant with one having a relatively higher degree of hydrophilicity, such as, for example, ARCOSOLV® PnP, or by replacing the rheological control agent with one that has a relatively higher degree of hydrophilicity, or one that has a relatively higher degree of substitution, such as METOLOSE® 60SH-4000, a substituted cellulose compound comprising anhydroglucose units that are each substituted by an average of about 1.9 substituents. The specific combinations of freezing point depressant and rheological control agent necessary to obtain a particular degree of gellation can be readily determined by one of skill in the art.

In certain instances it may be preferable for the liquid friction control compositions to be applied using a brush or as a fine atomized spray. A finely atomized spray may provide for faster drying of the composition, more uniform distribution of the material on top of the rail and may provide for improved lateral force reduction and retentivity. An atomized spray application of the liquid friction control compositions of the present invention may be preferable for on-board transit system applications, on-board locomotive applications and hi-rail vehicle applications, but the use of atomized spray is not limited to these systems.

Atomized spray application is also suitable for applying combinations of liquid friction modifier compositions of the present invention to different areas of the rail for optimizing the interactions between the rail-wheel interface. For example, one set of applicator systems and nozzles applies a friction modifier, for example but not limited to, an HPF composition to the heads of both rails, to reduce lateral slip-stick of the wheel tread across the rail head, while another applicator and nozzle system may apply a low friction composition, for example but not limited to LCF, to the gauge face of the outside rail to reduce the flanging effect of the wheel of the lead axle of a rail car. It is also possible to apply one frictional modifier of the present invention as a atomized spray, for example to the gauge face of the rail, with a second frictional modifier applied as a bead or as a solid stick on the rail head.

Liquid friction control compositions according to the present invention which are contemplated to be applied as an atomized spray preferably exhibit characteristics, such as, but not limited to a reduction of coarse contaminants which may lead to clogging of the spray nozzles of the delivery device, and reduction of viscosity to ensure proper flow through the spray system of the delivery device and minimize agglomeration of particles. Materials such as, but not limited to, bentonite may comprise coarse particles which clog nozzles with small diameters. However, materials of a controlled, particle size, for example but not limited to particles of less than about 50 $\mu$M may be used for spray application.

Alternatively, but not to be considered limiting, the liquid friction control compositions of the present invention may be applied through wayside (trackside) application, wherein a wheel counter may trigger a pump to eject the composition of the present invention through narrow ports onto the top of a rail. In such an embodiment, the unit is preferably located before the entrance to a curve and the material is distributed by the wheels down into the curve where the composition of the current invention may reduce noise, lateral forces, the development of corrugations, or combination thereof.

Specific compositions of the liquid friction control compositions of the current invention may be better suited for wayside application. For example, it is preferable that compositions for wayside application dry by forming a light skin on the surface without thorough drying. Compositions which dry "through" may clog nozzle ports of the wayside applicator and be difficult to remove. Preferably, liquid friction control compositions for wayside application comprise a form of carboxymethylcellulose (CMC) or a substituted cellulose compound in place of bentonite as the binder or rheological control agent.

The liquid friction modifier compositions of the present invention may be prepared using a high-speed mixer to disperse the components. A suitable amount of water is placed in a mixing vat and the rheological controlagent is added slowly until all the rheological controlagent is wetted out. The friction modifier is then added in small quantities and each addition thereof is allowed to disperse fully before subsequent additions of friction modifier are made. If the mixture comprises a lubricant, this component is added slowly and each addition is allowed to disperse fully before making subsequent additions. Subsequently, the retentivity agent, freezing point depressant, and other components, for example wetting agent, antibacterial agent, are added along with the remaining water and the composition is mixed thoroughly.

While the method of preparing the friction modifier compositions of the current invention have been disclosed above, those of skill in the art will note that several variations for preparing the formulations may exist without departing from the spirit and the scope of the current invention.

The liquid friction control compositions of the current invention preferably dehydrate following application onto a surface, and prior to functioning as a friction control composition. For example, but not wishing to be limiting, compositions of the present invention may be painted on a rail surface prior to the rail surface engaging a wheel of a train. The water, and any other liquid component in the compositions of the present invention may evaporate prior to engaging the wheel of a train. Upon dehydration, the liquid friction control compositions of the present invention preferably form a solid film which enhances adhesion of the other components of the composition, such as the friction modifier, and lubricant, if present. Further, after dehydration, the rheological control agent may also reduce reabsorption of water and prevent its removal from surfaces by rain or other effects. However, in certain applications contemplated by the present invention, the liquid friction control compositions of the present invention may be sprayed directly onto the rail by a pump located on the train or alternatively, the compositions may be pumped onto the rail following the sensing of an approaching train. Someone of skill in the art will appreciate that frictional forces and high temperatures associated with the steel-wheel travelling over the steel-rail may generate sufficient heat to rapidly dehydrate the composition.

The friction modifier compositions of the present invention may comprise components that one of skill in the art will appreciate may be substituted or varied without departing from the scope and spirit of the present invention. In addition, it is fully contemplated that the friction modifier compositions of the present invention may be used in combination with other lubricants or friction control compositions. For example, but not wishing to be limiting, the compositions of the current invention may be used with other friction control compositions such as, but not limited those disclosed in U.S. Pat. Nos. 5,308,516 and 5,173,204 (which are incorporated herein by reference). In such an embodiment, it is fully contemplated that the friction control composition of the present invention may be applied to the rail head while a composition which decreases the coefficient of friction may be applied to the gauge face or the wheel flange.

The above description is not intended to limit the claimed invention in any manner, furthermore, the discussed combination of features might not be absolutely necessary for the inventive solution.

The present invention will be further illustrated in the following examples. However, it is to be understood that these examples are for illustrative purposes only, and should not be used to limit the scope of the present invention in any manner.

EXAMPLE 1

Characterization of Liquid Friction Control Compositions

Amsler Protocol

Retentivity was tested using the Amsler machine. This device simulates the contact between the wheel of a train and the rail, and measures the coefficient of friction between the two bodies over time. The Amsler machine uses two different discs to simulate the wheel and rail. The two discs are kept in contact by an adjustable spring at a constant force. A composition is applied to a clean disc in a controlled manner to produce a desired thickness of coating on the disc. For the analysis disclosed herein the compositions are applied using a fine paint brush to ensure complete coating of the disc surface. The amount of applied composition is determined by weighing the disc before and after application of the composition. Composition coatings range from 2 to 12 mg/disc. The composition is allowed to dry completely prior to testing. Typically, the coated discs are left to dry for at least an 8 hour period. The discs are loaded onto the amsler machine, brought into contact and a load is applied from about 680 to 745 N, in order to obtain a similar Hertzian Pressure (MPa) over different creep levels resulting from the use of different diameter disc combinations. Unless otherwise indicated, tests are performed at 3% creep level (disc diameters 53 mm and 49.5 mm; see Table 1). For all disc size combinations (and creep levels from 3 to 30%) the speed of rotation is 10% higher for the lower disc than the upper disc. The coefficient of friction is determined by computer from the torque measured by the amsler machine. The test is carried out until the coefficient of friction reaches 0.4, and the number of cycles or seconds determined for each tested composition.

TABLE 1

Disc diameters for different creep levels

| Creep levels (%) | D1 (mm) | D2 (mm) |
|---|---|---|
| 3 | 53 | 49.5 |
| 10 | 50 | 50.1 |
| 15 | 40.3 | 42.4 |
| 24 | 42.2 | 48.4 |

Standard Manufacturing Process for LCF, HPF or VHPF

1) To about half of the water, add the full amount of rheological agent and allow the mixture to disperse for about 5 minutes;
2) Add wetting agent if present, for example but not limited to CO-630®, and allow to disperse for about 5 minutes;
3) Add defoaming agent, for example but not limited to COLLOIDS 675®, and neutralizing agent, if present, for example but not limited to AMP-95®, and allow mixture to disperse;
4) Add friction modifier, if present, in small amounts to the mixture, allowing each addition to completely disperse prior to making subsequent additions;
5) Add lubricant, if present in small amounts, allowing each addition to completely disperse prior to making subsequent additions;
6) Allow mixture to disperse for 5 minutes.
6) Remove sample from the vat and if desired, perform viscosity, specific gravity and filtering tests and adjust ingredients to meet desired specifications;
7) Decrease the speed of the dispenser and add retentivity agent, consistency agent, freezing point depressant (if present), and preservative. Optionally, any wetting agent and defoaming agent not added previously may be added and allowed to disperse;
8) Add remaining water and mix thoroughly.

Standard Process for Determining Freezing Point Temperatures

Freezing point temperatures were determined using a freezing point device from Nisku Instruments. The device was initially designed for the ASTM test for determining the freezing point of jet fuel (ASTM D2386). Generally, to perform the test, a sample is placed in a tube that is inserted into a Dewar flask containing solid carbon dioxide-cooled isopropyl alcohol as the refrigerant, and a thermometer and stirrer are inserted into the sample tube below the liquid level of the sample. During operation, the stirrer is used to constantly agitate the sample. By monitoring the behaviour of the temperature of the sample while cooling, the freezing point of the sample can be observed as a temperature plateau.

Examples of sample LCF, HPF and VHPF compositions are presented in Tables 2, 3 and 4, below.

TABLE 2

Sample LCF Composition

| Component | Percent (wt %) |
|---|---|
| Water | 48.1 |
| Propylene Glycol | 13.38 |
| Bentonite | 6.67 |
| Molybdenum sulfide | 13.38 |
| Ammonia | 0.31 |
| RHOPLEX ® 284 | 8.48 |
| OXABAN ® A | 0.07 |
| CO-630 ® | 0.1 |
| Methanol | 4.75 |

The LCF composition of Table 2 is prepared as outlined above, and tested using an amsler machine. The LCF composition is characterized with having a low coefficient of friction with increased creep levels.

TABLE 3

Sample HPF Composition

| Component | Percent (wt %) |
|---|---|
| Water | 55.77 |
| Propylene Glycol | 14.7 |
| Bentonite | 7.35 |
| Molybdenum sulfide | 4.03 |
| Talk | 4.03 |
| Ammonia | 0.37 |
| RHOPLEX ® 284 | 8.82 |
| OXABAN ® A | 0.7 |
| CO-630 ® | 0.11 |
| Methanol | 4.75 |

HPF compositions are characterized as having an increase in the coefficient of friction with increased creep levels.

Extending the Effect of an HPF Composition Applied to a Steel Surface in Sliding-rolling Contact with Another Steel Surface by Adding a Retentivity Agent The composition of Table 3 was modified to obtain levels of an acrylic retentivity agent (RHOPLEX® 284) of 0%, 3%, 7% and 10%. The increased amount of retentivity agent was added in place of water, on a wt % basis. These different compositions were then tested using the Amsler machine (3% creep level) to determine the length of time the composition maintains a low and steady coefficient of friction. The analysis was stopped when the coefficient of friction reached 0.4. The addition of a retentivity agent increases the duration of the effect (reduced coefficient of friction) of the HPF composition. A coefficient of 0.4 is reached with an HPF composition lacking any retentivity agent after about 3000 cycles. The number of cycles is increase to 4,000 with HPF compositions comprising 3% retentivity agent. With HPF comprising 7% acrylic retentivity agent, the coefficient of friction is below 0.4 for 6200 cycles, and with HPF comprising 10% acrylic retentivity agent, 8,200 cycles are reached.

The composition of Table 3 was modified to obtain levels of an several different t retentivity agents included into the composition at 16%. The retentivity agent was added in place of water, on a wt % basis. These different compositions were then tested using the Amsler machine (creep level 3%) to determine the number of cycles that the composition maintains a coefficient of friction below 0.4. The results are presented in Table 3A.

TABLE 3A

Effect of various retentivity agents within an HPF composition on the retentivity of the composition on a steel surface in rolling sliding contact.

| Retentivity Agent | No. of cycles before CoF > 0.4 |
|---|---|
| No retentivity agent | 3200 |
| ACRONAL ® | 5600 |
| AIRFLEX ® 728 | 6400 |
| ANCAREZ ® AR 550 | 7850 |
| RHOPLEX ® AC 264 | 4900 |

These results demonstrate that a range of film-forming retentivity agents improve the retentivity of friction control compositions of the present invention.

Effect of an Epoxy Retentivity Agent

The composition of Table 3 was modified to obtain levels of an epoxy retentivity agent (ANCAREZ® AR 550) of 0%, 8.9%, 15% and 30%. The increased amount of retentivity agent was added in place of water, on a wt % basis. These different compositions were then tested using the Amsler machine (3% creep level) to determine the number of cycles the composition maintains a coefficient of friction below 0.4. The results demonstrate that the addition of an epoxy retentivity agent increases the duration of the effect (reduced coefficient of friction) of the HPF composition. An HPF composition lacking any retentivity agent, exhibits an increase in the coefficient of friction after about 3,200 cycles. The number of cycles is extended to about 7957 cycles with HPF compositions comprising 8.9%% epoxy retentivity agent. With HPF comprising 15% epoxy retentivity agent, the coefficient of friction is maintained at a low level for about 15983 cycles, and with HPF comprising 30% epoxy retentivity agent, the coefficient of friction is reduced for about 16750 cycles.

Different curing agents were also examined to determine if any modification to the retentivity of the composition between two steel surfaces in sliding-rolling contact. Adding from about 0.075 to about 0.18 (resin:curing agent on a wt % basis) of ANQUAMINE® 419 or ANQUAMINE® 456 maintained the retentivity of HPF at a high level as previously observed, about 3,000 to about 4,000 seconds (15480 cycles), over the range of curing agent tested. There was no effect in either increasing or decreasing the retentivity of the composition comprising an epoxy retentivity agent (ANCAREZ® AR 550; at 28 wt % within the HPF composition) with either of these two curing agents. However, increasing the amount of ANCAMINE® K54 from 0.07 to about 0.67 (resin:curing agent on a wt % basis) increased the retentivity of the HPF composition from about 4,000 seconds (15500 cycles) at 0.07 (resin:curing agent wt %; equivalent to the other curing agents tested), to about 5,000 seconds (19350 cycles) at 0.28 (resin:curing agent wt %), to about 7,000 seconds (27,000 cycles) at 0.48 (resin:curing agent wt %), and about 9,300 seconds (35990 cycles) at 0.67 (resin:curing agent wt %).

In the absence of any curing agent, and with an epoxy amount of 28 wt %, the retentivity of the HPF composition as determined by Amsler testing was improved over HPF compositions comprising epoxy and a curing agent (about 4,000 seconds, 15500 cycles), to about 6900 seconds (26700 cycles). A higher retentivity is also observed with increased amounts of epoxy resin within the friction control composition, for example 8,000 seconds (as determined by Amsler testing) in compositions comprising 78% resin. However, the amount of resin that can be added to the composition must not be such that the effect of the friction modifier is overcome. Formulations that lack any curing agent may prove useful under conditions that limit the use of separate storage tanks for storage of the friction control composition and curing agent, or if simplified application of the friction control composition is required.

These results demonstrate that epoxy resins improve the retentivity of friction control compositions of the present invention.

TABLE 4

Sample VHPF Composition*

| Component | Percent (wt %) |
|---|---|
| Water | 57.52 |
| Propylene Glycol | 21.54 |
| Bentonite | 8.08 |
| Barytes | 5.93 |
| Ammonia | 0.54 |
| RHOPLEX ® 264 | 6.01 |
| OXABAN ® A | 0.1 |
| CO-630 ® | 0.16 |

*Mapico black (black iron oxide) may be added to colour the composition.

VHPF compositions are characterized as having an increase in the coefficient of friction with increased creep levels

EXAMPLE 2

Liquid Friction Control Compositions—Sample Composition 1

This example describes the preparation of another liquid frictional control composition characterized in exhibiting a high positive coefficient of friction. The components of this composition are listed in Table 5.

TABLE 5

High Positive Coefficient of Friction (HPF) Composition

| Component | Percent (wt %) |
|---|---|
| Water | 43.62 |
| Propylene Glycol | 14.17 |
| Bentonite | 2.45 |
| Molybdenum sulfide | 12 |
| Magnesium silicate | 12 |
| Ammonia | 0.28 |
| RHOPLEX ® 264 | 15.08 |
| OXABAN ® A | 0.28 |
| CO-630 ® | 0.12 |

Propylene glycol may be increased by about 20% to enhance low temperature performance. This composition is prepared as outlined in Example 1.

The composition of Table 6, was applied on the top of rail using an atomized spray system comprising a primary pump that fed the liquid composition from a reservoir through a set of metering pumps. The composition is metered to an air-liquid nozzle where the primary liquid stream is atomized with 100 psi air. In such a manner a controlled amount of a composition may be applied onto the top of the rail. Application rates of 0.05 L/mile, 0.1 L/mile 0.094 L/mile and 0.15 L/mile were used. The composition was applied on a test track, high tonnage loop 2.7 miles long consisting of a range of track sections encountered under typical conditions. Test trains accumilate 1.0 million gross ton (MTG) a day traffic density, using heavy axel loads of 39 tons. Train speed is set to a maximum of 40 mph. During the trials draw bar pull, and lateral force were measured using standard methods.

On uncoated track (no top of rail treatment, however, wayside lubrication, typically oil, was used) lateral forces varied from about 9 to about 13 kips. Application of HPF (composition of Table 5) to the top of rail resulted in a decrease in lateral force from about 10 kips (control, no HPF applied) to about 7.8 kips at 0.05 L/mile, about 6 kips at 0.1 L/mile, about 5 kips at 0.094 L/mile, and about 4 kips at an application rate of 0.15 L/mile (high rail measurements). Similar results are observed with the HPF composition of Table 5 in the presence or absence of a retentivity agent.

In order to examine retentivity of the HPF composition, HPF (of Table 5), comprising a retentivity agent) was applied to the top of rail and let set for 16 hours prior to train travel. Reduced lateral force was observed for about 5000 axle passes In the absence of any retentivity agent, an increase in lateral force is observed following 100–200 axle passes (data not presented). An intermediate level of retentivity is observed when the HPF composition of Table 5 is applied to the top of rail as the train is passing over the track and not permitted to set for any length of time, Under these conditions, when the application of HPF is turned off, an increase in lateral force is observed after about 1200 axle passes.

A reduction in noise is also observed using the liquid friction control composition of Table 5. A B&K noise meter was used to record decibel levels in the presence or absence of HPF application. In the absence of any top of rail treatment, the noise levels were about 85–95 decibels, while noise levels were reduced to about 80 decibels with an application of HPF at a rate of 0.047 L/mile.

A reduction in drawbar force (kw/hr) is also observed following the application of HPF to the top of rail. In the absence of HPF application, drawbar forces of about 307 kw/hr in the presence of wayside lubrication, to about 332 kw/hr in the absence of any treatment is observed. Following the application of HPF (Table 5 composition) drawbar forces of about 130 to about 228 were observed with an application rate of 0.15 L/mile.

Therefore, the HPF composition of Table 5 reduces lateral forces in rail curves, noise, reduces energy consumption, and the onset of corrugations in light rail systems. This liquid friction control composition may be applied to a rail as an atomized spray, but is not intended to be limited to application as an atomized spray, nor is the composition intended to be used only on rails. Furthermore, increased retentivity of the HPF composition is observed with the addition of a retentivity agent, supporting the data observed using the Amsler machine.

EXAMPLE 3

Liquid Friction Control Composition—Sample HPF Composition 2

This example describes a liquid composition characterized in exhibiting a high and positive coefficient of friction. The components of this composition are listed in Table 6.

TABLE 6

High and Positive Coefficient of Friction (HPF) Composition

| Component | Percent (wt %) |
|---|---|
| Water | 76.87 |
| Propylene Glycol | 14 |
| HECTABRITE ® | 1.5 |
| Molybdenum disulfide | 1.99 |
| Magnesium silicate | 1.99 |
| Ammonia | 0.42 |
| RHOPLEX ® 284 | 2.65 |
| OXABAN ® A | 0.42 |
| CO-630 ® | 0.1 |
| COLLOIDS 648 ® | 0.06 |

The liquid friction control composition is prepared as outlined in Example 1, and may be applied to a rail as an atomized spray, but is not intended to be limited to application as an atomized spray, nor is the composition intended to be used only on rails.

This liquid friction control composition reduces lateral forces in rail curves, noise, the onset of corrugations, and reduces energy consumption, and is suitable for use within a rail system.

EXAMPLE 4

Liquid Friction Control Composition—Sample Composition 3

This example describes the preparation of several wayside liquid frictional control compositions characterized in exhibiting a high positive coefficient of friction. The components of these compositions are listed in Table 7.

TABLE 7

High Positive Coefficient of Friction (HPF) Composition - wayside

| Component | Percent (wt %) | |
|---|---|---|
| Water | 71.56 | 71.56 |
| Propylene glycol | 14.33 | 14.33 |
| METHOCEL ® F4M | 1.79 | 1.79 |
| Molydenum disulfide | 3.93 | 3.93 |
| Magnesium silicate | 3.93 | — |
| Calcium carbonate | — | 3.93 |
| Ammonia | 0.35 | 0.35 |
| RHOPLEX ® 284 | 3.93 | 3.39 |
| OXABAN ® A | 0.07 | 0.07 |

Propylene glycol may be increased by about 20% to enhance low temperature performance. METHOCEL200 F4M may be increased by about 3% to increase product viscosity. METHOCEL® may also be replaced with bentonite/glycerin combinations.

The liquid friction control composition disclosed above may be used as a wayside friction control composition, but is not intended to be limited to such an application.

EXAMPLE 5

Liquid Friction Control Compositions—Sample Composition 4

This example describes the preparation of several other liquid frictional control composition characterized in exhibiting a high positive coefficient of friction. The components of these compositions are listed in Table 8.

TABLE 8

High Positive Coefficient of Friction (HPF) Composition

| | Percentage (wt %) | |
|---|---|---|
| Component | HPF Magnesium silicate | HPF clay |
| Water | 65.16 | 65.16 |
| Propylene glycol | 14 | 14 |
| Bentonite | 3 | 3 |
| Molybdenum disulfide | 4 | — |
| Graphite | — | 4 |
| Magnesium silicate | 4 | — |
| Kaolin clay | — | 4 |
| Ammonia | 0.42 | 0.42 |
| RHOPLEX ® 284 | 8.9 | 8.9 |
| OXABAN ® A | 0.42 | 0.42 |
| CO-630 ® | 0.1 | 0.1 |

Propylene glycol may be increased by about 20% to enhance low temperature performance.

The liquid friction control composition, and variations thereof may be applied to a rail as an atomized spray, but is not intended to be limited to atomized spray application, nor is the composition intended to be used only on rails.

The liquid friction control composition of the present invention reduces lateral forces in rail curves, noise, the onset of corrugations, and reduces energy consumption.

EXAMPLE 6

Liquid Friction Control Compositions—Sample Composition 5

This example describes the preparation of a liquid frictional control composition characterized in exhibiting a very high and positive coefficient of friction. The components of this composition are listed in Table 9.

TABLE 9

Very high and positive friction (VHPF) composition

| Component | Percentage (wt %) |
|---|---|
| Water | 72.85 |
| Propylene Glycol | 14.00 |
| HECTABRITE ® | 1.50 |
| Barytes | 8.00 |
| Ammonia | 0.42 |
| RHOPLEX ® AC 264 | 2.65 |
| OXABAN ® A | 0.42 |
| CO-630 ® | 0.10 |
| Colloids 648 ® | 0.06 |

Propylene glycol may be increased by about 20% to enhance low temperature performance.

The liquid friction control composition, and variations thereof may be applied to a rail as an atomized spray, but is not intended to be limited to atomized spray application, nor is the composition intended to be used only on rails.

The liquid friction control composition of the present invention reduces lateral forces in rail curves, noise, the onset of corrugations, and reduces energy consumption.

EXAMPLE 7

Liquid Friction Control Compositions—Sample Composition 6

This example describes the preparation of a liquid frictional control composition characterized in exhibiting a low coefficient of friction. The components of this composition are listed in Table 10

TABLE 10

Low coefficient of friction (LCF) composition

| Component | Percentage (wt %) |
|---|---|
| Water | 72.85 |
| Propylene Glycol | 14.00 |
| HECTABRITE ® | 1.50 |
| Molybdenum Disulphide | 8.00 |
| Ammonia | 0.42 |
| RHOPLEX ® AC 264 | 2.65 |
| OXABAN ® A | 0.42 |
| CO-630 ® | 0.1 |
| COLLOIDS 648 ® | 0.06 |

EXAMPLE 8

Liquid Friction Control Compositions—Sample Composition 7

This example describes the preparation of liquid frictional control compositions characterized in exhibiting a low coefficient of friction, and comprising or not comprising the retentivity agent RHOPLEX® AC 264. The components of these compositions are listed in Table 11

TABLE 11

Low coefficient of friction (LCF) composition

| | Percentage (wt %) | |
|---|---|---|
| Component | with retentivity agent | no retentivity agent |
| Water | 56.19 | 58.73 |
| Propylene Glycol | 15.57 | 16.27 |
| Bentonite | 7.76 | 8.11 |
| Molybdenum Disulphide | 15.57 | 16.27 |
| Ammonia | 0.38 | 0.4 |
| RHOPLEX ® AC 264 | 6.33 | 0 |
| Biocide (OXABAN ® A) | 0.08 | 0.08 |
| CO-630 ® | 0.11 | 0.11 |

The retentivity of these compositions was determined using an Amsler machine as outline in example 1. The number of cycles for each composition at a 30% creep level was determined at the point where the coefficient of friction reached 0.4. In the absence of retentivity agent, the number of cycles for LCF prior to reaching a coefficient of friction of 0.4 was from 300 to 1100 cycles. In the presence of the retentivity agent, the number of cycles increased from 20,000 to 52,000 cycles.

EXAMPLE 9

Compositions Comprising Antioxidants in the Presence or Absence of a Retentivity Agent Styrene Butadine Retentivity Agent Compositions were prepared as outlined in Example 1, however, a synergistic blend of thioester and hinder phenol, in this case OCTOLITE® 424-50, as an antioxidant, was added, along with the retentivity agent (e.g. DOW LATEX 226®) to the composition in step 1 of the standard manufacturing process. An example of an antioxidant based frictional control composition is outlined in Table 12. This composition comprises a styrene butadine based retentivity agent (DOW LATEX 226NA®).

TABLE 12

Antioxidant Sample Composition with a Styrene Butadiene based Retentivity Agent

| Component | No antioxidant Weight Percent | With antioxidant Weight Percent | With antioxidant; no Retentivity agent Weight Percent |
|---|---|---|---|
| Water | 53.58 | 53.58 | 61.41 |
| Dow 226NF ® | 11.03 | 11.03 | — |
| Bentonite | 7.35 | 7.35 | 7.35 |
| Octolite ® 242-50 | — | 3.2 | 3.2 |
| Molybdenium Disulfide | 4.03 | 4.03 | 4.03 |
| OXABAN ® | 0.07 | 0.07 | 0.07 |
| Methyl Hydride | 4.75 | 4.75 | 4.75 |
| Propylene Glycol | 14.7 | 14.7 | 14.7 |
| Ammonia | 0.35 | 0.35 | 0.35 |
| Co 630 | 0.11 | 0.11 | 0.11 |
| Talc | 4.03 | 4.03 | 4.03 |

The retentivity of these compositions was determined using an Amsler machine, essentially as described in Example 1. Each composition was painted onto 8 discs with dry weights ranging from one to seven grams. The discs were allowed at least two hours to dry, and then were run on the Amsler at 3% creep. Each run was converted into a point based on the mass of the friction control composition consumed and the time taken to reach a Coefficient of Friction (CoF) of 0.40. These points (mass, time) were graphed and a regression applied. This gave a collection of points and a line of best fit for each sample. The points used to create the regression were converted into consumption rates (mass/time). These consumption rates were averaged, and a standard error calculated based on the data. A lower consumption rate is indicative of longer retentivity.

The consumption rate for the composition with DOW LATEX 226® (a styrene based retentivity agent) but without the antioxidant was 0.0013 mg/min. The consumption rate for the composition with DOW LATEX 226® and the antioxidant (OCTOLITE® 424-50,) was 0.0005 mg/min, demonstrating increased retentivity of the composition in the presence of an antioxidant.

Similar results were also obtained using WINGSTAY® S (a styrenated phenol antioxidant) in combination with the retentivity agent, where the composition exhibited a consumption rate of 0.0009 mg/min.

Furthermore, a similar increase in the retentivity of the composition is observed in the presence of the antioxidant OCTOLITE® 424-50 in the absence of a retentivity agent.

Acrylic Base Retentivity Agent

Compositions were prepared as outlined in Example 1, however, an antioxidant (in this case OCTOLITE® 424-50) was added to the composition in step 1 along with retentivity agent, during the standard manufacturing process. The retentivity agent in this case was an acrylic, RHOPLEX® AC-264. An example of an antioxidant based frictional control composition is outlined in Table 13.

TABLE 13

| Antioxidant Sample Composition with an Acrylic based Retentivity Agent | | |
|---|---|---|
| | Percentage (wt %) | |
| Component | with antioxidant | without antioxidant |
| Water | 52.59 | 55.79 |
| RHOPLEX ® AC 264 | 8.82 | 8.82 |
| Bentonite | 7.35 | 7.35 |
| Octolite ® 424-50 | 3.2 | — |

TABLE 13-continued

| Antioxidant Sample Composition with an Acrylic based Retentivity Agent | | |
|---|---|---|
| | Percentage (wt %) | |
| Component | with antioxidant | without antioxidant |
| Molybdenium Disulfide | 4.03 | 4.03 |
| Propylene Glycol | 14.7 | 14.7 |
| OXABAN ® A | 0.07 | 0.07 |
| Methyl Hydride | 4.75 | 4.75 |
| CO-630 ® | 0.11 | 0.11 |
| Ammonia | 0.35 | 0.35 |
| Talc | 4.03 | 4.03 |

The retentivity of the compositions listed in Table 13 was determined using an Amsler machine as in Example 8. Consumption rates for the composition without the antioxidant were about 0.0026 mg.min, compared to a consumption rates for compositions comprising an acrylic based retentivity agent, RHOPLEX® AC 264, which were about 0.0019, indicating increased retentivity of the composition in the presence of the retentivity agent.

EXAMPLE 10

Compositions Comprising Different Antioxidants

Compositions were prepared as outlined in Example 1, however, various antioxidant, were added to the composition in step 1, with or without a retentivity agent, during the standard manufacturing process. The antioxidant tested include:

an amine type antioxidant, for example WINGSTAY® 29 (Goodyear Chemicals);

a styrenated phenol type antioxidant, for example, WINGSTAY® S (Goodyear Chemicals);

a hindered type antioxidant, for example, WINGSTAY® L (Goodyear Chemicals);

a thioester type antioxidant, for example WINGSTAY® SN-1 (Goodyear Chemicals);

a synergistic blend comprising a hindered phenol and a thioester, for example, OCTOLITE® 424-50 (Tiarco Chemical).

The compositions tested are listed in Table 14.

TABLE 14

| Friction Control Compositions with an Antioxidant (no added Retentivity Agent) | | | | | | | |
|---|---|---|---|---|---|---|---|
| | Percentage (wt %) | | | | | | |
| Component | No Anti-oxidant | WINGSTAY ® 29 | WINGSTAY ® S | WINGSTAY ® L | WINGSTAY ® SN-1 | OCTOLITE ® 424-50 | OCTOLITE ® 424-50 (HC) |
| Water | 50 | 49 | 49 | 49 | 49 | 49 | 48 |
| $MbS_2$ | 4 | 4 | 4 | 4 | 4 | 4 | 4 |
| Anti-oxidant | — | 1 | 1 | 1 | 1 | 1 | 2 |
| Propylene Glycol | 15 | 15 | 15 | 15 | 15 | 15 | 15 |
| Methyl Hydride | 10 | 10 | 10 | 10 | 10 | 10 | 10 |
| Oxaban ® A | 0.01 | 0.01 | 0.01 | 0.01 | 0.01 | 0.01 | 0.01 |
| Co 630 | 0.1 | 0.1 | 0.1 | 0.1 | 0.1 | 0.1 | 0.1 |
| Bentonite | 7 | 7 | 7 | 7 | 7 | 7 | 7 |

The retentivity of the compositions listed on Table 14 were determined using an Amsler machine as in Example 8. All of the antioxidants showed an increase in the retentivity of the friction control composition as compared to a friction control composition that does not contain an antioxidant. An increase concentration of antioxidant ("Synergist HC") resulted in a more pronounced effect of reducing the consumption rate.

A similar set of compositions were prepared as outlined in Table 14, however, a retentivity agent (RHOPLEX AC-264®) was added (8.82 wt %) to the compositions, and the wt % of water reduced accordingly. The retentivity of the compositions were determined using an Amsler machine. All of the antioxidants tested showed an increase in the retentivity of the friction control composition as compared to a friction control composition lacking an antioxidant. Again, an increase concentration of antioxidant ("Synergist HC") resulted in a more pronounced effect of reducing the consumption rate.

EXAMPLE 11

Time Required to Remove Liquid Freezing Point Depressants from a Metal Surface To reduced slippage of metal surfaces in sliding rolling contact that have been treated with HPF or VHPF compositions comprising a freezing point depressant, the freezing point depressant component of these compositions may be selected so that they have a characteristic of evaporating, dehydrating or decomposing under the pressure and heat generated between the steel surfaces, for example, by the wheels of the train contacting a treated rail.

In this example, several candidate liquid freezing point depressants, which may form part of the liquid component of a friction control composition, are evaluated with respect to the time required to remove them from a pair of contacting metal surfaces simulating a rail/railcar wheel interface. Freezing point depressants that demonstrated removal times from the contacting metal surfaces that are lower than that of propylene glycol are considered suitable for use in VHPF, HPF, and LCF compositions of the present invention. Freezing point depressants that exhibit removal times greater than that of propylene glycol may be used within HPF and LCF compositions.

Freezing point depressants were identified by testing freezing point temperatures using a Freezing Point Device (from Nisku Instruments). A sample freezing point depressant is placed into the sample tube that is inserted within a Dewar flask containing solid carbon-dioxide cooled isopropyl alcohol. A thermometer and stirrer are placed within the sample tube. The freezing point of the sample is observed as a plateau in the drop of temperature of the sample. Freezing point depressants were determined by mixing the depressant with water, and determining the amount of depressant required to obtain a freezing point of −20° C. (data not shown). Freezing point depressants that were present at 50% (w/w) or less in the depressant-water mixture, and that exhibited a freezing point of −20° C. or less, were considered suitable for further testing.

The removal times for the freezing point depressants were determined using the Amsler machine as described in Example 1, except that only a freezing point depressant was applied to a clean rail disc in a controlled manner to produce a desired thickness of coating on the rail disc. The freezing point depressants were applied using a fine paint brush to ensure complete coating of the surface of the rail disc. The amount of applied composition was determined by weighing the disc before and after application of the composition. The amount of the coatings ranged from 2 to 12 mg/disc. The discs were loaded onto the Amsler machine, brought into contact with each other, and placed under a load of about 760 N. The applied samples were tested immediately after their application to the rail disc with no dry time prior to testing. Tests were performed at 3–4% creep level (disc diameters 53 mm and 49.5 mm). The coefficient of friction was determined by computer from the torque measured to turn the two wheels of the Amsler machine at a constant speed (232.2 RPM). The time required to remove each sample from the discs, the removal time, was taken to be the time required to reach a coefficient of friction of 0.4. Results of this test are presented in Table 15.

TABLE 15

Retentivity properties of Freezing point depressants

| Freezing Point Depressant | Removal Time (sec) | Vapor Pressure (mm Hg) |
|---|---|---|
| ARCOSOLV PNB | 81 | 0.92 (at 25° C.) |
| PROGLYDE DMM | 88 | 0.55 (at 20° C.) |
| ARCOSOLV PnP | 125 | 2.5 (at 25° C.) |
| ARCOSOLV PMA | 149 | 3.8 (at 25° C.) |
| ARCOSOLV PTB | 277 | 2.7 (at 25° C.) |
| DOWANOL DPM | 738 | 0.28 (at 20° C.) |
| DOWANOL DPnP | 1133 | 0.08 (at 20° C.) |
| Propylene Glycol | 2468 | 0.129 (at 25° C.) |
| Hexylene Glycol | 2785 | <0.1 (at 20° C.) |
| DOWANOL DPnB | 4468 | 0.04 (at 20° C.) |
| ARCOSOLV TPM | 6046 | <0.1 (at 25° C.) |

These tests demonstrated that several freezing point depressants exhibited removal times that were lower than that of propylene glycol (2468 s), and are, therefore, suitable for use in HPF, VHPF and LCF compositions.

In some compositions of the present invention, which include a lubricant component, for example, HPF and LCF compositions, the presence of a solvent component, which imparts a lubricating property on the composition may be acceptable, and the freezing point depressant component, need not be readily removable from the composition by evaporation, dehydration or decomposition. Freezing point depressants that exhibit removal times above that of propylene glycol may, therefore, also be used in the HPF or LCF compositions of the present invention.

Removal times of the freezing point depressants correlates with their vapor pressure values. Vapor pressure values may therefore also be used as a means for selecting for a suitable candidate freezing point depressant from among a group of candidate compounds. Freezing point depressants that are characterized as having a vapour pressure of about 0.1 (at 20° C.) or greater, may be used in the friction control compositions exhibiting a positive friction characteristic, for example, HPF and VHPF compositions, as well as LCF compositions. Similarly, freezing point depressants that are characterized as having a vapour pressure of less than about 0.1 (at 20° C.) may be suitable for use in the friction control compositions comprising a lubricant, for example, LCF and HPF compositions.

EXAMPLE 12

HPF Liquid Friction Control Compositions

This example describes liquid compositions characterized in exhibiting a high and positive coefficient of friction. The components of these compositions and associated freezing points are listed in Tables 16 and 17. In Tables 16 and 17, in order from left to right, PG (propylene glycol); DOWANOL® DPM; PROGLYDE® DMM (two concentrations); ACROSOLV® PTB; ACROSOLV®PnP; and CRYOTECH®PnP are used as freezing point depressants (FDP).

Combinations of freezing point depressants may also be used in the compositions described herein, as synergistic effects, of reduced freezing points, are observed when two or more freezing point depressants were mixed together. For example, compositions comprising both propylene glycol (at 7% w/w) and DOWANOL® DPM (at 23.5% w/w) exhibited a freezing point of −24.5° C. (see Table 16), yet a composition comprising either propylene glycol or DOWANOL® DPM on its own at 30.5% (w/w, the total amount of propylene glycol and DOWANOL® DPM) exhibits a freezing point of only −15° C., or −9° C., respectively. Similarly, a composition comprising both propylene glycol (at 14.83% w/w) and PROGLYDE® DMM (at 19.0% w/w) exhibits a freezing point of −28.0° C. (see Table 16). However, a composition comprising propylene glycol or PROGLYDE® DPM on its own at 33.83.0% (w/w, the total amount of propylene glycol and DOWANOL® DPM) exhibits a freezing point of only −20° C., or −10° C., respectively. Similar synergistic results were observed with other combinations of freezing point depressants (e.g. see Table 16).

TABLE 16

High and Positive Coefficient of Friction (HPF) Onboard Compositions (FDP: freezing point depressant)

| Component (wt. %) | Standard Onboard | PG Onboard | DOWANOL ® DPM Onboard | PROGLYDE ® DMM (B) Onboard | PROGLYDE ® DMM (C) Onboard | ARCOSOLV ® PTB Onboard | ARCOSOLV ® PnP Onboard | CRYO-TECH ® E36 Onboard |
|---|---|---|---|---|---|---|---|---|
| Water | 52.86 | 38.86 | 36.4 | 33.43 | 39.26 | 38.86 | 33.43 | 32.92 |
| Propylene Glycol | 14 | 14 | 7 | 14.83 | 15 | 16 | 14.2 | 14 |
| FPD | — | 14 | 23.5 | 19 | 13 | 12 | 19.43 | 20 |
| HECTABRITE ® DP | 0.35 | 0.35 | 0.35 | 0.35 | 0.35 | 0.35 | 0.35 | 0.35 |
| HBR | — | — | — | — | — | — | — | 0.94 |
| METHOCEL ® K4M | 1 | 1 | 0.96 | — | — | — | — | — |
| METOLOSE 60SH-4000 | — | — | — | 0.6 | 0.6 | 1 | 0.8 | — |
| TAMOL ® 731A | 0.22 | 0.22 | 0.22 | 0.22 | 0.22 | 0.22 | 0.22 | — |
| SURFYNOL ® CT-121 | 0.54 | 0.54 | 0.54 | 0.54 | 0.54 | 0.54 | 0.54 | 0.76 |
| COLLOIDS 675 ® | 0.5 | 0.5 | 0.5 | 0.5 | 0.5 | 0.5 | 0.5 | 0.5 |
| AMP-95 | 0.1 | 0.1 | 0.1 | 0.1 | 0.1 | 0.1 | 0.1 | 0.1 |
| $MoS_2$ UP 10 | 9 | 9 | 9 | 9 | 9 | 9 | 9 | 9 |
| Talc (NICRON ® 604) | 9 | 9 | 9 | 9 | 9 | 9 | 9 | 9 |
| RHOPLEX ® AC-264 | 11.93 | 11.93 | 11.93 | 11.93 | 11.93 | 11.93 | 11.93 | 11.93 |
| OXABAN ® A | 0.5 | 0.5 | 0.5 | 0.5 | 0.5 | 0.5 | 0.5 | 0.5 |
| Freezing Point (° C.) | −9 | −25.5 | −24.5 | −28 | −19.5 | −20 | −21 | −23 |

TABLE 17

High and Positive Coefficient of Friction (HPF) Trackside Freight Compositions

| Component (wt. %) | Standard Trackside | PROGLYDE ® DMM (B) Trackside | PROGLYDE ® DMM (C) Trackside | ARCOSOLV ® PTB Trackside | ARCOSOLV ® PnP Trackside | CRYOTECH ® E36 Trackside |
|---|---|---|---|---|---|---|
| Water | 66.04 | 40.5 | 47.35 | 47 | 40.34 | 47.04 |
| Propylene Glycol | 14 | 17.44 | 18.05 | 19 | 17.1 | 14 |
| Freezing Point Depressant | — | 23 | 15.54 | 14.44 | 23.4 | 20 |
| METOLOSE 60SH-4000 | — | 2 | 2 | 2.5 | 2.1 | — |
| Mecellose HPMC | 2.5 | — | — | — | — | — |
| HBR | — | — | — | — | — | 1.5 |
| CO 630 | 0.1 | 0.1 | 0.1 | 0.1 | 0.1 | 0.1 |
| COLLOIDS 675 ® | 0.5 | 0.1 | 0.1 | 0.1 | 0.1 | 0.5 |
| AMP-95 | 0.1 | 0.1 | 0.1 | 0.1 | 0.1 | 0.1 |
| $MoS_2$ UP 10 | 3.93 | 3.93 | 3.93 | 3.93 | 3.93 | 3.93 |
| Talc (NICRON ® 604) | 3.93 | 3.93 | 3.93 | 3.93 | 3.93 | 3.93 |
| RHOPLEX ® AC-264 | 8.8 | 8.8 | 8.8 | 8.8 | 8.8 | 8.8 |
| OXABAN ® A | 0.1 | 0.1 | 0.1 | 0.1 | 0.1 | 0.1 |
| Freezing point (° C.) | −9 | −28 | −19.5 | −20 | −21 | −18 |

The liquid friction control compositions are prepared as outlined in Example 1, and may be applied to a rail as an atomized spray, but are not intended to be limited to application as an atomized spray, nor are the compositions intended to be used only on rails.

Each of the liquid control compositions was applied to a stretch of rail exposed to sunlight, and a locomotive consisting of 18 axles passed over the rail immediately after the product was applied. The coefficient of friction of the top of rail was measured using a push tribometer and found in each case to be about 0.33, which is within the required range of the product.

The liquid friction control compositions reduce lateral forces in rail curves, noise, the onset of corrugations, and reduces energy consumption, and is suitable for use within a rail system.

EXAMPLE 13

Friction Control Composition (HPF)

This example describes an alternate composition characterized in exhibiting a high and positive coefficient of friction. The components of this composition are listed in Table 18. This composition demonstrated a freezing point of −28° C.

TABLE 18

| High and Positive Coefficient of Friction (HPF) Composition (No Retentivity Agent) | |
|---|---|
| Component | Percent (wt %) |
| Water | 46.363 |
| Sodium montmorillonite | 8.94 |
| Propylene Glycol | 14.83 |
| PROGLYDE ® DMM | 19 |
| Ammonia | 0.004 |
| Nonyl Phenoxypolyol; | 0.002 |
| Molybdenum Disulphide | 4.93 |
| Magnesium Silicate | 4.93 |

The friction control composition is prepared at room temperature by slowly adding to a mixing drum containing 35% of the total amount of water the rheological agent (i.e. bentonite (sodium montmorillonite)) and the wetting agent (ie. nonyl phenoxypolyol). The components of the mixture are mixed well until a thick gel is formed. While mixing, the balance of the ingredients are added in the following order: water (the remaining 65%), ammonia, ether E.B. (if any), any other liquids, solid lubricant (e.g. molybdenum) as required, and any other solids. These components are mixed thoroughly until a smooth mixture is obtained to ensure that the solid lubricant is well dispersed. The resulting composition is a thick, thixotropic liquid which is jelly-like when standing. Upon stirring or pumping the viscosity of the composition decreases. The composition is a matrix whose continuous phase is the rheological agent and which also contains a discontinuous phase, the solid lubricant.

The above composition may be applied to the coupling or rail surfaces or the like by means of which will be recognized by one in the art such as pump or brush. The composition is applied so that a film of the composition is evenly spread on the rail. The film is preferably a bead approximately one-eighth of an inch in diameter.

The binding agent works by absorbing the water in the composition. Over time the composition dehydrates to leave a solid bead and thereby enhances adhesion of the lubricant and friction modifier to the rail over previously used greases or polymer lubricant compositions. The binding agent additionally keeps the lubricant and friction modifier dispersed even after the wheel runs over the rail and also reduces reabsorption of water. Therefore, the composition is not easily removed by rain.

The friction control composition reduces lateral forces in rail curves, noise, the onset of corrugations, and reduces energy consumption, and is suitable for use within a rail system.

EXAMPLE 14

Liquid Friction Control Composition (VHPF)

This example describes a liquid composition characterized in exhibiting a high and positive coefficient of friction. The components of this composition are listed in Table 19. This composition demonstrated a freezing point of −28° C.

TABLE 19

| Very High Positive Coefficient of Friction (VHPF) Composition (No Retentivity Agent) | |
|---|---|
| Component | Percent (wt %) |
| Water | 51.424 |
| Sodium Montmorillonite | 9.45 |
| Ammonia | 0.004 |
| Propylene Glycol | 14.83 |
| PROGLYDE ® DMM | 19 |
| Nonyl Phenoxypolyol | 0.002 |
| Anhydrous Aluminum Silicate | 5.2 |
| Black Iron Oxide | 0.09 |

The liquid friction control composition is prepared as outlined in Example 22, and may be applied to a rail as an atomized spray, but is not intended to be limited to application as an atomized spray, nor is the composition intended to be used only on rails.

The composition produces a positive steel to steel friction characteristic in the range of 0 to 0.45 as the relative speed of sliding (creepage) is increased from zero to about 2.5%, rising to about 0.72 as creepage is increased to about 30%. These coefficient of friction levels are substantially above steel to steel friction coefficient levels obtained with conventional lubricants and above those of the lubricant composition disclosed in U.S. Pat. Nos. 5,173,204 and 5,308,516.

EXAMPLE 15

Liquid Friction Control Composition (LCF)

This example describes a liquid composition characterized in exhibiting a high and positive coefficient of friction. The components of this composition are listed in Table 20. This composition demonstrated a freezing point of −28° C.

TABLE 20

| Low Coefficient of Friction (LCF) Composition (No Retentivity Agent) | |
|---|---|
| Component | Percent (wt %) |
| Water | 45.672 |
| Sodium Montmorillonite | 12.621 |
| Propylene Glycol | 14.83 |
| PROGLYDE ® DMM | 19 |
| Ammonia | 0.004 |
| Nonyl Phenoxypolyol | 0.002 |
| Butoxyethanol | 3 |
| Molybdenum Disulphide | 4.871 |

The liquid friction control composition is prepared as outlined in Example 22, and may be applied to a rail as an atomized spray, but is not intended to be limited to application as an atomized spray, nor is the composition intended to be used only on rails.

Similar testing was done to that described in Example 12 and similar results were recorded.

All references are herein incorporated by reference.

The present invention has been described with regard to preferred embodiments. However, it will be obvious to persons skilled in the art that a number of variations and modifications can be made without departing from the scope of the invention as described herein. In the specification the word "comprising" is used as an open-ended term, substantially equivalent to the phrase "including but not limited to", and the word "comprises" has a corresponding meaning. Citation of references is not an admission that such references are prior art to the present invention.

What is claimed is:

1. A friction control composition comprising:

(a) from about 30 to about 55 weight percent water;

(b) from about 0.5 to about 20 weight percent of a rheological control agent;

(c) from about 0.1 to about 20 weight percent of a consistency modifier;

(d) from about 10 to about 30 weight percent of a freezing point depressant, and one or more of (i) from about 0 to about 20 weight percent retentivity agent;

(ii) from about 0 to about 30 weight percent lubricant; and (iii) from about 0.5 to about 30 weight percent friction modifier.

2. The friction control composition of claim 1, wherein said rheological control agent is selected from the group consisting of bentonite; hectorite; caseine; carboxymethylcellulose; carboxy-hydroxymethyl cellulose, cellulose substituted with a substituent selected from the group consisting of methyl, hydroxypropyl, hydroxyethyl, and a mixture thereof; ethoxymethylcellulose; chitosan; a starch; and a mixture thereof.

3. The friction control composition of claim 1, wherein said rheological control agent is a substituted cellulose compound comprising anhydroglucose units that are each substituted with a substituent selected from the group consisting of a methyl group, a hydroxypropyl group, a hydroxyethyl group, and a mixture thereof.

4. The friction control composition of claim 3, wherein each of the anhydroglucose units is substituted by an average of from about 1.3 to about 1.9 substituents.

5. The friction control composition of claim 1, wherein the consistency modifier is a glycol.

6. The friction control composition of claim 5, wherein the glycol is propylene glycol.

7. The friction control composition of claim 1, wherein the freezing point depressant is a glycol ether.

8. The friction control composition of claim 7, wherein the glycol ether is a propylene glycol ether.

9. The friction control composition of claim 1, wherein the freezing point depressant is selected from the group consisting of propylene glycol, dipropylene glycol methyl ester, dipropylene glycol dimethyl ether, dipropylene glycol monopropyl ether, propylene glycol tertiary butyl ether, propylene glycol normal propyl ether, dipropylene glycol monopropyl ether, propylene glycol methyl ether acetate, propylene glycol methyl ether acetate, and ethylene glycol butyl ether.

10. The friction control composition of claim 1, wherein the freezing point depressant is a salt.

11. The friction control composition of claim 10, wherein the salt is selected from the group consisting of betaine HCl, cesium chloride, potassium chloride, potassium acetate, sodium acetate, potassium chromate, sodium chloride, sodium formate, or sodium tripolyphosphate.

12. The friction control composition of claim 1, wherein the freezing point depressant is a composition comprising a metal acetate.

13. The friction control composition of claim 12, wherein the metal acetate is potassium acetate or sodium acetate.

14. The friction control composition of claim 1, wherein the freezing point depressant is an acid.

15. The friction control composition of claim 14, wherein the acid is citric acid, lactic acid, or succinic acid.

16. The friction control composition of claim 1, wherein the freezing point depressant is selected from the group consisting of a heterocyclic amine, an aryl alcohol, an amino acid, an amino acid derivative, and a carbohydrate.

17. The friction control composition of claim 1, wherein the consistency modifier and the freezing point depressant are both propylene glycol.

18. The friction control composition of claim 1, wherein the freezing point of the composition is −10° C. or lower.

19. The friction control composition of claim 1, further comprising a wetting agent, an antibacterial agent, a defoaming agent, or a combination thereof.

20. The friction control composition of claim 1, further comprising from about 0.5 to about 2 weight percent antioxidant.

21. The liquid friction control composition of claim 20, wherein said antioxidant is selected from the group consisting of a styrenated phenol type antioxidant; an amine type antioxidant, a hindered phenol type antioxidant; a thioester type antioxidant, and a combination thereof.

22. The friction control composition of claim 1, wherein said retentivity agent is selected from the group consisting of acrylic, polyvinyl alcohol, polyvinyl chloride, oxazoline, epoxy, alkyd, urethane acrylic, modified alkyd, acrylic latex, acrylic epoxy hybrids, polyurethane, styrene acrylate, and styrene butadiene, based compounds.

23. A friction control composition comprising:

(a) from about 30 to about 55 weight percent water;

(b) from about 0.5 to about 20 weight percent of a theological control agent selected from the group consisting of bentonite; hectorite; caseine; carboxymethylcellulose; carboxy-hydroxymethyl cellulose; cellulose substituted with a substituent selected from the group consisting of methyl, hydroxypropyl, hydroxyethyl, and a mixture thereof; ethoxymethylcellulose; chitosan; a starch; and a mixture thereof;

(c) from about 0.1 to about 20 weight percent of a consistency modifier;

(d) from about 10 to about 30 weight percent of a freezing point depressant;

(e) from about 0 to about 20 weight percent retentivity agent, and (f) from about 1 to about 30 weight percent lubricant.

24. The friction control composition of claim 23, wherein said rheological control agent is a substituted cellulose compound comprising anhydroglucose units that are each substituted with a substituent selected from the group consisting of a methyl group, a hydroxypropyl group, a hydroxyethyl group, and a mixture thereof.

25. The friction control composition of claim 24, wherein each of the anhydroglucose units is substituted by an average of from about 1.3 to about 1.9 substituents.

26. The friction control composition of claim 23, wherein the consistency modifier is propylene glycol.

27. The friction control composition of claim 23, wherein the freezing point depressant is selected from the group consisting of propylene glycol, dipropylene glycol methyl ester, dipropylene glycol dimethyl ether, dipropylene glycol monopropyl ether, propylene glycol tertiary butyl ether, propylene glycol normal propyl ether, dipropylene glycol monopropyl ether, propylene glycol methyl ether acetate, propylene glycol methyl ether acetate, and ethylene glycol butyl ether.

28. A method of controlling noise between two steel surfaces in sliding-rolling contact, comprising applying the friction control composition as defined in claim 1 to at least one of said two steel surfaces.

29. The method of claim 28, wherein in said step of applying, said liquid control composition is sprayed onto said at least one of said two steel surfaces.

30. The composition of claim 1, wherein the friction control composition exhibits a viscosity of up to about 7,000 cP.

31. The composition of claim 1, wherein the friction control composition exhibits a viscosity between about 5,000 and about 200,000 cP.

* * * * *